US008131194B2

(12) United States Patent
Kakyo

(10) Patent No.: US 8,131,194 B2
(45) Date of Patent: Mar. 6, 2012

(54) IMAGE FORMATION APPARATUS HAVING A DETECTED PART IN A RECESS IN THE BELT

(75) Inventor: Hideaki Kakyo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 599 days.

(21) Appl. No.: 12/325,342

(22) Filed: Dec. 1, 2008

(65) Prior Publication Data

US 2009/0238614 A1 Sep. 24, 2009

(30) Foreign Application Priority Data

Mar. 21, 2008 (JP) ..... 2008-073799
Aug. 6, 2008 (JP) ..... 2008-202652

(51) Int. Cl.
*G03G 15/01* (2006.01)

(52) U.S. Cl. ..... 399/302; 399/303

(58) Field of Classification Search ..... 399/302, 399/303

See application file for complete search history.

(56) References Cited

U.S. PATENT DOCUMENTS

| | | | | |
|---|---|---|---|---|
| 5,819,140 | A * | 10/1998 | Iseki et al. | 399/303 |
| 5,995,794 | A * | 11/1999 | Osada et al. | 399/302 |
| 2005/0238371 | A1* | 10/2005 | Sudo et al. | 399/302 |
| 2005/0286930 | A1 | 12/2005 | Sawai et al. | |
| 2006/0120740 | A1 | 6/2006 | Yamada et al. | |

FOREIGN PATENT DOCUMENTS

| | | |
|---|---|---|
| JP | A-60-145903 | 8/1985 |
| JP | A-60-226890 | 11/1985 |
| JP | A-61-089230 | 5/1986 |
| JP | A-62-156135 | 7/1987 |
| JP | A-05-106054 | 4/1993 |
| JP | A-05-247219 | 9/1993 |
| JP | A-06-128040 | 5/1994 |
| JP | A-09-264236 | 10/1997 |
| JP | A-10-069819 | 3/1998 |
| JP | A-11-316506 | 11/1999 |
| JP | A-2000-337464 | 12/2000 |
| JP | A-2003-114558 | 4/2003 |
| JP | A-2004-046199 | 2/2004 |
| JP | A-2004-252487 | 9/2004 |
| JP | A-2006-11003 | 1/2006 |
| JP | A-2003-107819 | 4/2006 |
| JP | A-2006-139029 | 6/2006 |
| JP | A-2006-227412 | 8/2006 |

OTHER PUBLICATIONS

Notification of Reasons for Refusal mailed on Jan. 26, 2010 in corresponding Japanese Patent Application No. 2008-202652 (with translation).

Maruzen; "Koubunshi Daijiten;" 1994; pp. 935-939 (with English-language translation).

* cited by examiner

*Primary Examiner* — David Gray
*Assistant Examiner* — Laura Roth
(74) *Attorney, Agent, or Firm* — Oliff & Berridge, PLC

(57) ABSTRACT

An image formation apparatus belt, including a belt that includes a belt main body, the belt having a recess; and a detected part for position detection that is located in a side edge region of the belt, the detected part being placed in the recess provided in the belt and covered with a ceramic film.

8 Claims, 13 Drawing Sheets

IMAGE FORMATION APPARATUS HAVING A DETECTED PART IN A RECESS IN THE BELT

CROSS-REFERENCE TO RELATED APPLICATION

This application is based on and claims priority under 35 USC 119 from Japanese Patent Applications No. 2008-073799 filed Mar. 21, 2008 and No. 2008-202652 filed Aug. 6, 2008.

BACKGROUND

1. Technical Field

This invention relates to an image formation apparatus belt, a belt stretching unit and an image formation apparatus.

2. Related Art

For example, a color image formation apparatus adopting an intermediate transfer system using an intermediate transfer belt is available as an image formation apparatus using electrophotography. In the image formation apparatus, an intermediate transfer belt adapted to come in contact with a transfer section of an image supporter (for example, a photoconductive drum) on which a toner image is formed according to an electrophotographic process, etc., and rotate is stretched on a plurality of rolls. A plurality of toner images formed on the image supporter are primarily transferred so that they are once overlapped at the same position of the intermediate transfer belt and then the toner images transferred onto the intermediate transfer belt are secondarily transferred to a sheet of paper in batch. The multi-color toner image secondarily transferred onto the sheet is then fixed by a fixing unit and becomes a color image.

In addition, a color image formation apparatus of tandem type using a sheet conveying belt for conveying a sheet of paper so as to allow the sheet to pass through transfer sections of a plurality of image formation units is also available as an image formation apparatus including a belt. In the image formation apparatus, the image formation units each for forming a toner image of each color component individually are placed side by side and the sheet conveying belt is stretched on a plurality of rolls so as to come in contact with the transfer section of each image formation unit and rotate. The sheet attracted to the sheet conveying belt and held thereon is conveyed so as to allow the sheet to pass through the transfer sections of the image formation units, whereby the toner images formed in the image formation units are transferred to the same sheet of paper so that they are overlapped in order, and finally the image is fixed to form a color image.

In the image formation apparatus including the belt, highly accurate position control is indispensable for precisely overlapping the toner images. Hitherto, position control of a belt has been performed by detecting a specific position of the belt with a sensor.

SUMMARY

According to an aspect of the invention, there is provided an image formation apparatus belt, including;

a belt that includes a belt main body, the belt having a recess; and a detected part for position detection that is located in a side margin of the belt, the detected part being placed in the recess provided in the belt.

BRIEF DESCRIPTION OF THE DRAWINGS

Exemplary embodiments of the present invention will be described in detail based on the following figures, wherein.

DETAILED DESCRIPTION

In an image formation apparatus belt of an embodiment of the invention, each detected part for position detection is placed in a side margin of a belt and is placed in a recess provided in the belt. In the image formation apparatus belt of the embodiment, a detected part is placed in the recess provided in the belt and thus does not come in contact with any other member (for example, each roll on which the belt is stretched) in the long-term use of the belt and rubbing and peeling are suppressed. The belt may be formed with a recess and the material of the member of the belt is not limited to a transparent member.

The image formation apparatus belt of the exemplary embodiment will be discussed below with reference to the accompanying drawings.

(Image Formation Apparatus Belt)

The image formation apparatus belt of the exemplary embodiment (which will be hereinafter also called simply "belt") is not limited if it is a belt used with an image formation apparatus; it may be any of belts for a photoconductive body, for intermediate transfer, for sheet conveying, for image fixing, etc. Among them, the image formation apparatus belt of the exemplary embodiment can be preferably used particularly as a belt for intermediate transfer or a belt for sheet conveying for which high position accuracy is required.

Figure 1:
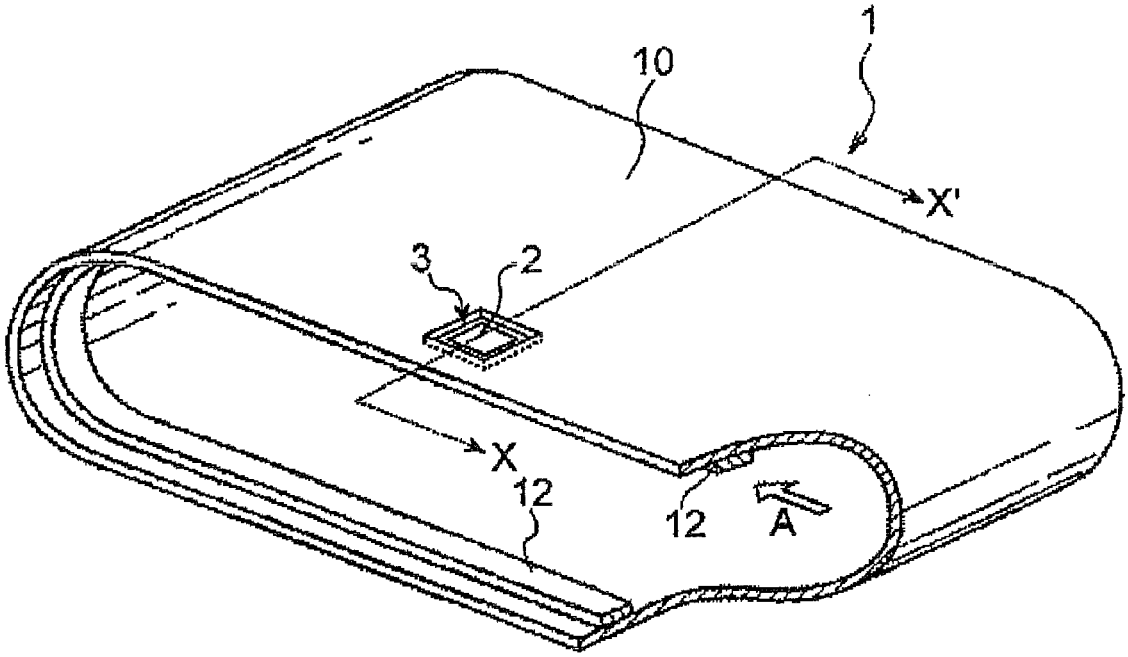
FIG. 1 is a perspective view to show an image formation apparatus belt of an example of the exemplary embodiment of the invention.

The belt of the exemplary embodiment will be discussed with reference to the accompanying drawings. FIG. 1 is a perspective view to show an image formation apparatus belt of an example of the exemplary embodiment of the invention (partially a sectional view). FIGS. 2A to 2D are sectional views of the image formation apparatus belt taken on line X-X' viewed from the arrow A direction in FIG. 1.

In FIG. 1, in an image formation apparatus belt 1, a detected part for position detection (which will be hereinafter also called simply "detected part") 2 is placed in a side margin of the belt. The detected part 2 is placed in a recess 3 provided in the belt. The term "side margin" contains an end part and is used to mean an area in the proximity of both sides other than the image part.

In the image formation apparatus belt 1 shown in FIG. 1, a guide member 12 is provided on the back of a belt main body 10 along a side margin thereof.

In FIG. 1, the guide member 12 is provided on the back of the belt main body 10, but the embodiment is not limited to the mode; the image formation apparatus belt may have no guide member. The guide member can also be provided in one side margin of the belt main body or may be provided in both side margins. Further, a reinforcing member for reinforcing the belt main body 10 may be provided on the opposite side with the belt main body 10 of the guide member 12 between and may be provided with a recess and the detected part may be placed in the recess. The term "image formation apparatus belt" is used to mean the belt containing all of the belt main body and the guide member and the reinforcing member provided in the belt main body and the like.

In FIG. 1, the detected part for position detection is placed on the surface (outer peripheral surf ace) of the belt, but may be provided on the back (inner peripheral surface) of the belt.

<Detected Part>

In the embodiment, the shape of the detected part is not limited and can be selected as required from among a circle, an elapse, a square, a rectangle, etc. The size of the detected part can also be selected conforming to the detection sensitivity and the size of the belt.

One or more detected parts may be placed in a belt and two or more detected parts can also be placed; the number of the detected parts is not limited.

The detected part is placed in the recess provided in the belt. The shape of the recess is not limited; preferably the recess is a recess having an opening to the outside and more preferably is a recess rectangular in cross section and having an opening to the outside. In the embodiment, the cross-sectional shape of the recess is not limited to it and a trapezoid may be adopted. Preferably, the detected part is placed in the inner bottom part of the recess.

Figure 3:
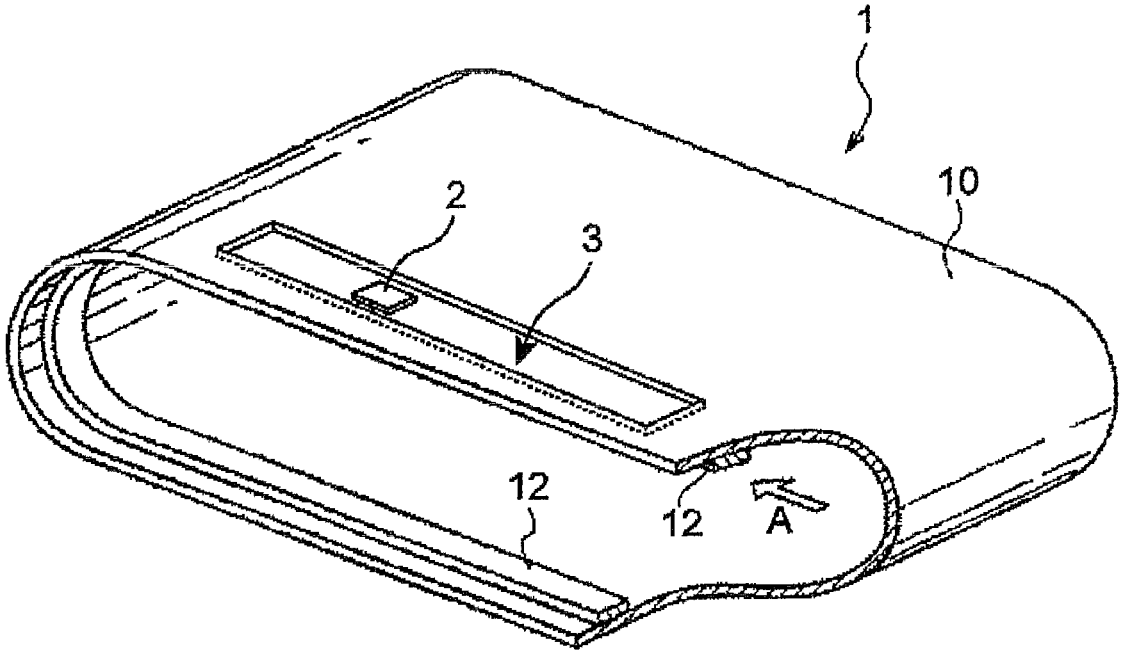
FIG. 3 is a perspective view to show the image formation apparatus belt of another example of the exemplary embodiment of the invention.

The shape of the recess is not limited and may allow the detected part to be placed in the recess. FIG. 3 is a perspective view to show the image formation apparatus belt of another example of the exemplary embodiment of the invention. For example, as shown in FIG. 3, the recess 3 can be shaped like a groove; the recess may be shaped like a groove and provided like a circumference in a side margin of the belt and the detected part may be placed discontinuously.

In FIG. 1, the detected part is provided in the recess provided in the belt main body, but the embodiment is not limited to the mode; the guide member may be provided with a recess, preferably a recess having an opening to the outside and the detected part may be placed in the recess.

Figure 2A:
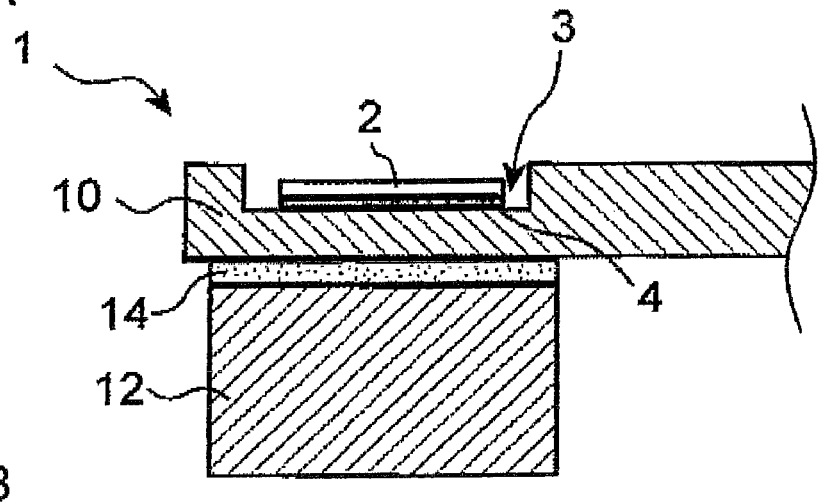
FIGS. 2A to 2D are sectional views of the image formation apparatus belt taken on line X-X' viewed from the arrow A direction in FIG. 1.

Referring to FIG. 2A, the recess 3 is provided on the outer periphery of the belt main body 10 and the detected part 2 is placed in the inner wall of the recess 3 through an adhesive 4.

Figure 2B:
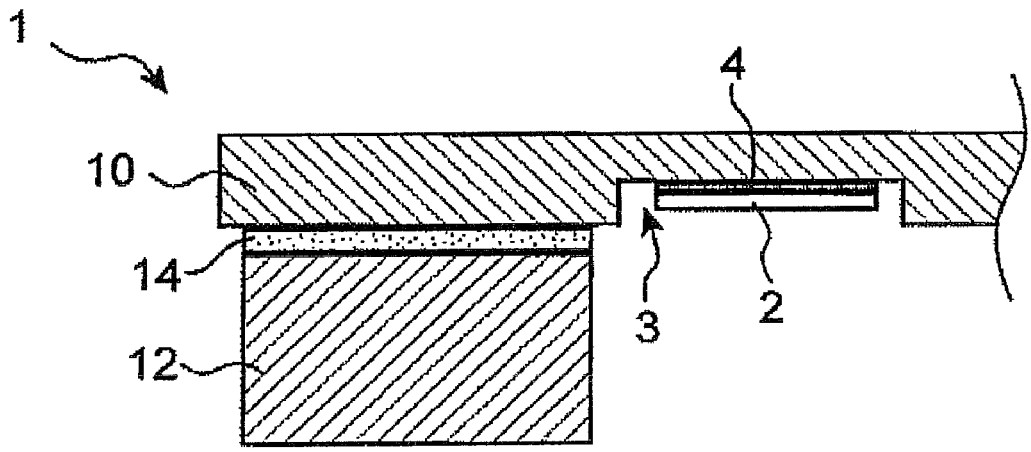
Figure 2C:
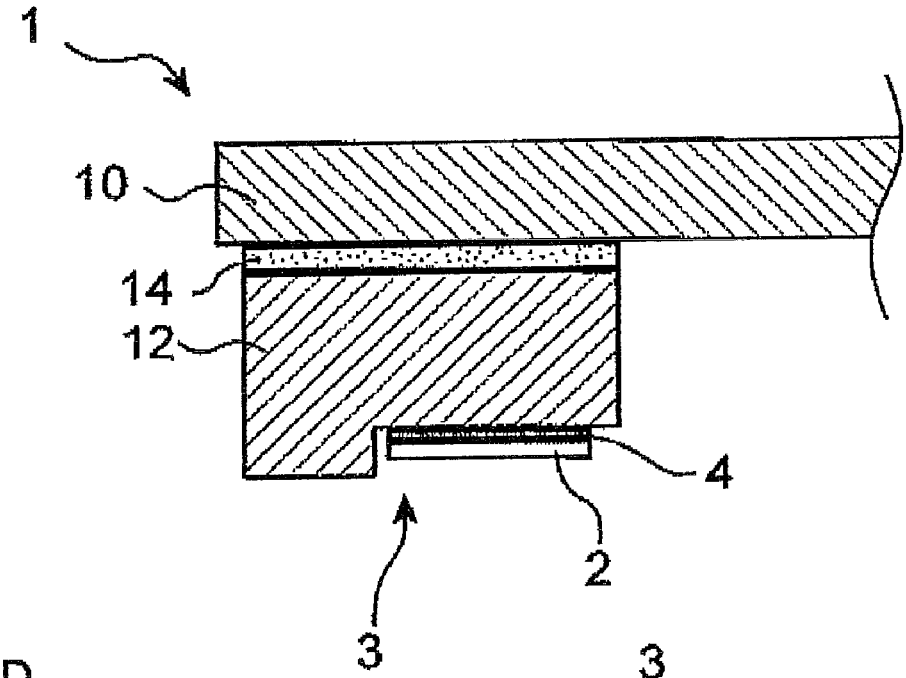
Figure 2D:
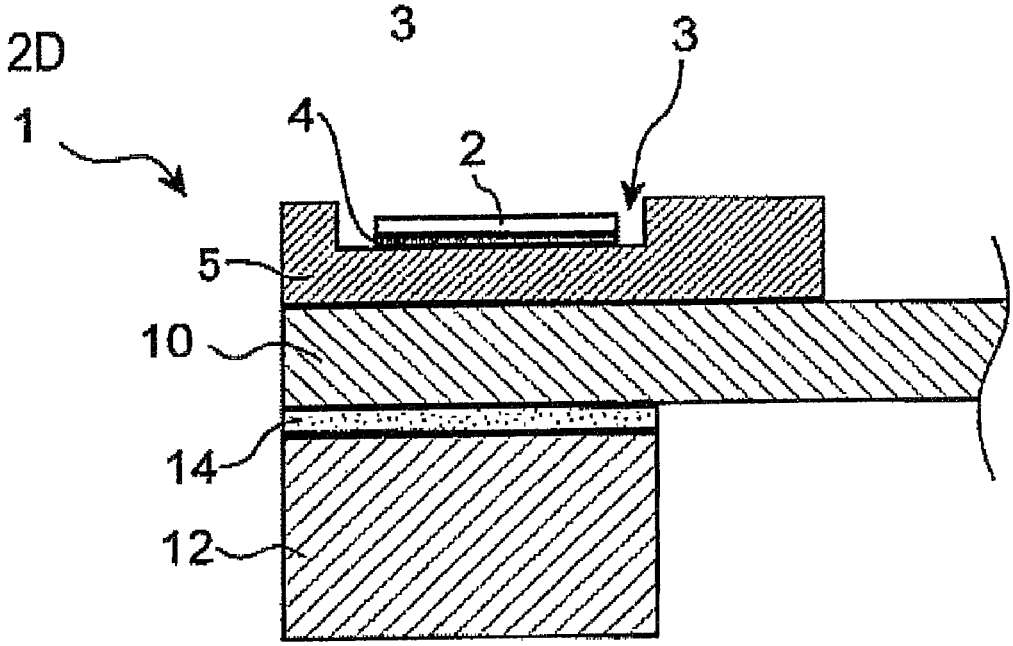

In FIG. 2B, the recess 3 is provided on the inner periphery of the belt main body 10 and the detected part 2 is placed in the inner wall of the recess 3 through the adhesive 4. In FIG. 2C, the recess 3 is provided in the guide member 12 and the detected part 2 is provided in the inner wall of the recess 3 through the adhesive 4. In FIG. 2D, a reinforcing member 5 is provided on the opposite side (outer periphery) to the face where the guide member 12 of the belt main body 10 is provided. The recess 3 is provided in the reinforcing member 5 and the detected part 2 is placed in the inner wall of the recess 3 through the adhesive 4.

In the invention, the recess is not limited to a recess with only one face having an opening to the outside as shown in FIGS. 2A, 2B and 2D and may have two faces opened to the outside as shown in FIG. 2C.

The detected part is not limited if it can be detected by a detection sensor; preferably the belt of the embodiment uses a light reflecting part having reflectivity as the detected part. Metal of silver, gold, aluminum, copper, etc., can be exemplified as the reflecting component of the light reflecting part; aluminum is preferred.

The light reflecting part may be formed by evaporating into the recess provided in the belt or may be formed by fixedly securing a light reflecting member into the recess. Copper, aluminum foil, etc., or a plastic film having a metal thin film on a surface can be exemplified as the light reflecting member; either or both of a pressure sensitive adhesive and an adhesive are applied to the light reflecting member, which then can be put on and placed in the recess.

Preferably, the optical reflectance of the light reflecting part is 30% or more; more preferably, 50% or more; furthermore preferably, 70% or more. It the optical reflectance is in the range mentioned above, high detection sensitivity can be provided.

Preferably, the belt and the detected part are selected so that one absorbs light of the sensor and the other reflects light of the sensor.

The thickness of the detected part is not limited; considering the thickness and durability of the belt, preferably the thickness of the detected part is 1 to 30 μm; more preferably, 1 to 20 μm; furthermore preferably, 1 to 10 μm. If the detected part is fixedly secured to the recess through either or both of a pressure sensitive adhesive and an adhesive, the thickness of the detected part also contains the thickness of either or both of the pressure sensitive adhesive and the adhesive. However, if the detected part is covered with an optically transparent resin as described later, the thickness of the optically transparent resin is not contained.

The detected part may be placed in the recess according to any method; preferably, the detected part is placed in the belt without a pressure sensitive adhesive or an adhesive. If the detected part is placed without a pressure sensitive adhesive or an adhesive, peeling of the detected part is hard to occur and durability is enhanced.

To place the detected part in the belt without a pressure sensitive adhesive or an adhesive, a method of applying a belt applying liquid to a molding core material and drying it and then pressing a detected part (preferably, a light reflecting member) and then heating and calcinationating, thereby fixedly securing the detected part can be exemplified. The method is described later in detail.

Preferably, the detected part is covered with an optically transparent resin, so that occurrence of a surface flaw on the detected part and deposition of dirt on the detected part can be prevented and durability is enhanced. That is, preferably the detected part is provided with a protective layer as it is covered with an optically transparent resin.

As the material of the optically transparent resin, PET (polyethylene terephthalate), PP (polypropylene), polyimide, polyvinyl chloride, polyamideimide, acrylic resin, transparent ceramic, etc., can be exemplified. Among them, PET and polyimide are preferred from the viewpoint of scratch resistance.

Preferably, the optical transmittance of the optically transparent resin is 40% or more; more preferably, 50% or more; furthermore preferably, 60% or more. If the optical transmittance is in the range mentioned above, good detection sensitivity can be provided.

As a method of covering the detected part with an optically transparent resin, spray coating, a print method, an applying method, a method of putting a tape-like optically transparent resin, or the like can be exemplified, and the method is not limited.

Preferably, the thickness of the optically transparent resin is 3 to 100 μm; more preferably, 5 to 75 μm; furthermore preferably, 5 to 50 μm.

If the thickness of the optically transparent resin is in the range mentioned above, the protection effect of a surface flaw and dirt of the detected part is good and the intimate contact property with the belt is good.

Preferably, the detected part is covered with a ceramic film. The ceramic film has high hardness and gives excellent scratch resistance to the detected part.

Preferably, the ceramic film is placed in the detected part without a pressure sensitive adhesive or an adhesive; accordingly extrusion of a pressure sensitive adhesive or an adhesive does not occur and the ceramic film can be placed in the detected part. Particularly, preferably the ceramic film is calcined integrally with the belt main body and is molded (integrally molded). In this case, it is advantageous in the process because the ceramic film is molded at the same time as the belt main body.

The thickness of the ceramic film may be selected as required in the range in which the detection sensitivity of the detected part can be provided sufficiently; preferably the thickness of the ceramic film is 2 μm to 40 μm; more preferably, 10 μm to 20 μm.

Preferably, the ceramic film is formed by calcinating a preceramic polymer. On the other hand, the ceramic itself has a very high softening point and thus it is extremely difficult to mold using a melt processing method. The preceramic polymer is a ceramic precursor and is molded to any desired shape and then becomes ceramics as it is calcined.

Most ceramics produced from the preceramic polymer contain silicon as a main body. A ceramic alloy with the Si, C, N, O ratio changed is also produced from a preceramic polymer and further chemical modification can also be executed with metal alkoxide, etc.

Polycarbosilane, polysiloxane, polyborosiloxane, polytitano siloxane, polysilazane, polysilastyrene, hydrogen silsesquioxane, metallo polycarbosilane (for example, polytitano carbosilane), polyaluminoxane, bolandine, polyaluminum nitride, ladder type silicone, mineralization silicone, etc., can be exemplified as the preceramic polymer preferably used for the invention, and Japanese Patent Laid-open No. 145903/1985, 226890/1985, 89230/1986, 156135/1987, 106054/1993, 247219/1993, 264236/1997, 69819/1998, "Koubunshi Daijiten" (Maruzen, published in 1994, p. 935 to p. 939), etc., can be referenced.

Among them, as the preceramic polymer, polysiloxane (silicone resin), polyborosiloxane and tyranno polymer (polytitano carbosilane) are preferred, and from the viewpoint of excellent heat resistance, tyranno polymer (polytitano carbosilane) is particularly preferred.

Polysiloxane is an inorganic polymer having the structure represented by the following expression as the basic unit;

$$Si(—O—)_n(—R)_{4-n}$$

wherein R represents a monovalent organic group and an alkyl group (preferably, having a carbon number of 1 to 10; more preferably having a carbon number of 1 to 6) and an aryl group (preferably, having a carbon number of 6 to 20; more preferably having a carbon number of 6 to 10) can be exemplified. The monovalent organic group may be further substituted, and a hydroxyl group, a cyano group, a halogen atom, etc., can be exemplified as the substituent.

Polysiloxane can be manufactured by conducting polycondensation of a functional organosilane compound of chloro organosilane, dichloro organosilane, triorganosilane, etc., for example, in the presence of metallic sodium. Preferably, polysiloxane has a weight average molecular weight of 200 to 5,000,000; more preferably 500 to 3,000,000.

As examples of articles on the market, of polysiloxane that can be used in the invention, Toshiba silicone TSR116, TSR117, TSR127B, TSR144, TSR145, YR3187, YR3168 and YR3370 (manufactured by Toshiba silicone), SH804, SH805, SH806A, SH808, SH840, SH2107, SH2108 and SH2400 (manufactured by TORAY Silicone), Shin'etsu Silicone KR271, KR282, KR311, KR255 and KR155 (manufactured by Shin'etsu Silicone), and the like are available. As silicone resin, in addition to pure silicone, silicone alkyd resin, silicone polyester resin, silicone acrylic resin, silicone epoxy resin, silicone urethane resin, a polysiloxane derivative containing organic modifier silicone, and the like can also be used.

Polyborosiloxane is an inorganic polymer having the structure of the following expression as the basic unit:

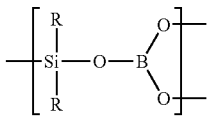

wherein R represents a monovalent organic group, and an alkyl group (preferably, having a carbon number of 1 to 10; more preferably having a carbon number of 1 to 6) and an aryl group (preferably, having a carbon number 6 to 20; more preferably having a carbon number of 6 to 10) can be exemplified.

To obtain polyborosiloxane, for example, a method of obtaining polyborosiloxane by reaction of a boric acid and dichlorodiphenyl silane or diphenyl silanediol and a method of manufacturing polyborosiloxane by heating and performing polycondensation of dimethyl diacetoxy silane and methyl ester borate in a solvent can be exemplified. Preferably, the weight molecular weight is 500 to 50,000; more preferably, 1,000 to 10,000.

Polysilazane can be synthesized from cyclosilazane of $(R_2SiNR)_3$, etc., (where R represents a hydrogen atom or an alkyl group) and chlorosilane ($R_nSiCl_{4-n}$ where n=0, 1, 2 or 3 and R is a hydrogen atom or an alkyl group). This synthesizing method is described in detail in Japanese Patent Laid-Open No. 128040/1994.

Polytitano carbosilane is an organic metal cross-linked polymer which becomes a precursor of Si—Ti—C—O based ceramic also called tyranno polymer. Generally, it can be provided by adding a small amount of a reaction promoter and a proper amount of a titanium compound to polydimethyl silane and performing thermal polycondensation. Polytitano carbosilane is a network polymer provided by cross linking a straight-chain polymer mainly consisting of a carbosilane skeleton (Si—C) by titanalkoxide. Preferably, polytitano carbosilane has a weight average molecular weight of 500 to 10,000; more preferably 700 to 3,000. Polytitano carbosilane is calcined at 200° C. to 700° C. and becomes ceramic. Preferably, the calcination time is 15 minutes to five hours; more preferably, 30 minutes to three hours.

Polytitano carbosilane is substantially an amorphous polymer and has features of high compatibility with metal and high acid resistance.

Polytitano carbosilane is available on the market; for example, Tyranno coat VN-100 manufactured by Ube Kousan (Kabu), etc., can be named.

Preferably, the preceramic polymer is calcined at 250° C. to 550° C.; more preferably, the preceramic polymer is calcined at 300° C. to 380° C. Preferably, the calcination time is 10 minutes to four hours; more preferably, 10 minutes to one hour. The calcination temperature and the calcination time are selected conforming to the type, the mold thickness, etc., of the preceramic polymer to be used.

A mode in which the detected part is a ceramic film containing a metal filler is also preferred.

A metal filler is added to the preceramic polymer and the preceramic polymer containing the metal filler is applied to the recess provided in the belt and is calcined together with the belt, whereby the detected part excellent in hardness and scratch resistance is provided. The metal filler gives reflectivity and functions as a light reflecting part, so that it is suited to the use as the detected part. Further, integral molding with the belt is possible and excellent adhesion can also be provided.

As the metal filler, powder of metal of gold, silver, palladium, indium, copper, nickel, zinc, lead, bismuth, etc., a metal oxide, a metal carbide, a metal nitride, etc., such as $Al_2O_3$, $SiO_2$, silicon carbide, silicon nitride, silicon hexaboride, aluminum nitride, boron nitride, boron carbide, titanium boride, boron or titanium carbide can be exemplified.

Among them, $Al_2O_3$ or silver is preferred from the viewpoint of giving reflectivity to the detected part.

Preferably, the mean particle size of the metal filler is 1 μm to 100 μm; more preferably, 5 μm to 50 μm. If the mean particle size of the metal filler is in the range mentioned above, dispersibility is excellent and excellent reflectivity is presented. If the metal filler is not like particles, the particle size means the sphere-equivalent particle size.

The metal filler is not limited to a metal tiller shaped like particles and may be any shape of a needle, a flat plate, a spheroid, etc.

The addition amount of the metal filler can be selected as required so long as the detected part has sufficient reflectivity. Preferably, it is 0.5% to 10% by weight of the whole formed ceramic film (after calcined); more preferably 1% to 5% by weight.

If the addition amount of the metal filler is 0.5% by weight or more, reflectivity is given; if the addition amount of the metal filler is 10% by weight or less, the strength of the provided ceramic film is excellent.

The size and the depth of the recess can be selected as required conforming to the required size of the detected part and are not limited. Preferably, the depth of the recess is 5 to 200 μm; more preferably 10 to 150 μm; furthermore preferably 15 to 100 μm. If the depth of the recess is in the range mentioned above, the detected part can be placed in the recess and the mechanical strength of the belt is not impaired.

The depth of the recess is formed so as to become larger than the height of the detected part (if the detected part is covered with an optically transparent resin, the whole height). That is, the depth of the recess is selected so that a convex part is not produced on the belt surface (the outer or inner peripheral surface).

In the embodiment, the position at which the detected part is provided is not limited if it is a side margin of the belt; preferably the detected part is placed in a non-image part. To provide the detected part on the outer peripheral surface of the belt, if the detected part is provided in an image part, it will cause an image lack to occur. To provide the detected part on the inner peripheral surface of the belt, the electrostatic property is affected and degradation of the image quality may be caused to occur. Therefore, in the embodiment, preferably the detected part is placed in a non-image part.

The belt 1 of the embodiment can be included in the image formation apparatus described later so that it is supported for rotation by a plurality of rolls. It is a resin belt having the belt main body 10 with the outer peripheral surface that can function as a paper holding face for holding a sheet of paper to which a toner image is transferred, an intermediate transfer face for transferring the toner image, a photosensitive face for forming a latent image, a charging face for charging a contacted member, a developer holding face for holding a developer, etc. The belt is used preferably for a photosensitive unit, an intermediate transfer unit, a transfer detachment unit, a conveying unit, a charging unit, a developing unit, etc., in an electrophotographic copier, a laser printer, etc. The material, the shape, the size, etc., of the belt main body forming a part of the belt of the embodiment can be set as required in response to the application, the function, etc., of the belt.

As shown in FIGS. 1 and 2A to 2D, in the embodiment, preferably the belt 1 is provided with the guide member 12 on the surface of the belt main body 10 along a side margin thereof. Preferably, the guide member 12 is provided on the belt main body 10 through an adhesion part 14. However, a mode in which the guide member is adhered directly to the surface of the belt main body is not excluded. Preferably, the guide member 12 is provided on the inner peripheral surface (inner face) of the belt main body 10 as shown in FIG. 1, but may be provided on the outer peripheral surface (outer face) of the belt main body 10 in response to the application of the belt 1.

<Belt Main Body>

As the material of the belt main body, a resin material having Young's modulus 2,000 MPa or more is used preferably. A resin material having Young's modulus 2,000 MPa or more is used, whereby deformation caused by an external stress is suppressed at the belt running time. The larger the Young's modulus of the belt main body, the better the function. Practically, however, the Young's modulus is 8,000 MPa or less; preferably 6,000 MPa or less. The Young's modulus of the belt main body can be controlled in the range mentioned above by selecting the chemical structure of the resin material to be used, and if the material contains an aromatic ring structure, the Young's modulus becomes higher.

The Young's modulus is found by conducting a tension test conforming to JIS K 7172, drawing a tangent to a curve of an initial strain area of the found stress-strain curve, and finding the gradient of the tangent.

As the material of the belt main body, a polyimide-based resin, a polyamideimide-based resin, a polyester-based resin, a polyamide-based resin, a fluorine-based resin, etc., can be named. The belt main body may be seamless or may not be seamless if it is annular. Preferably, the thickness of the belt main body usually is about 0.02 to 0.2 mm.

To use the belt of the embodiment particularly as an intermediate transfer belt or a sheet conveying belt, a semiconductive belt using a polyimide-based resin containing a conductant agent or a polyamideimide-based resin containing a conductant agent is used preferably as the belt main body. The term "semiconductive (semiconductivity)" is used to mean meeting the range of surface resistivity and the range of volume resistivity described later.

The belt main body using a polyimide-based resin containing a conductant agent or a polyamideimide-based resin containing a conductant agent can be manufactured by a known method of applying a polyamideimide solution containing a conductant agent to the outer face of a cylindrical body, drying and heating it, and peeling off the polyamideimide resin coat from the cylindrical body, etc., for example.

To use the belt of the embodiment as an intermediate transfer belt or a sheet conveying belt, preferably the surface resistivity is controlled in the range of $1\times10^{9}\Omega/\square$ to $1\times10^{14}\Omega/\square$ and the volume resistivity is controlled in the range of $1\times10^{8}$ to $1\times10^{13}$ Ωcm. Thus, a conductant agent (conductive filler) can be added as required. As the conductant agent, carbon black of Ketchen black, acetylene black, etc., metal or an alloy of graphite, aluminum, nickel, copper alloy, etc., a metal oxide of tin oxide, zinc oxide, potassium titanate, tin oxide-indium oxide or tin oxide-antimony oxide complex oxide, etc., a conductive polymer of polyaniline, polypyrrole, polysulfone, polyacetylene, etc., or the like can be used preferably. The conductive fillers may be used alone or in combination. Among them, carbon black is preferred as the conductive filler from the viewpoint of the cost. A processing aid of a dispersing agent, a lubricant, etc., can be added as required.

The surface resistivity is measured conforming to JIS K 6911 in an environment of 22° C., 55% RH using a Highrester UPMCP-450 model UR probe manufactured by (Kabu) Dia Instrument. Twenty-four points of the belt (three points in the width direction×eight points in the circumferential direction) are measured and an average value thereof is adopted as the surface resistivity of the belt.

Preferably, the belt main body is formed of a flexible material as described above; a thermoplastic resin or synthetic rubber having elasticity is used preferably. Preferably, the belt main body consists mainly of a polyimide resin or a polyamideimide resin hard to degrade or deteriorate from the viewpoint of the durability of the belt main body.

A manufacturing example of the belt main body is given below: 15 to 35 parts by weight of carbon black per 100 parts by weight of resin component are added as a conductant agent to solvent soluble polyamideimide resin (manufactured by Toyobou (Kabu); Viromax HR16NN, etc.,) or polyimide resin (manufactured by Ube Kousan (Kabu); U varnish S, etc.,) and the mixture is dispersed to provide a coating liquid and this coating liquid is applied to the outer face of an aluminum pipe and then calcination is performed to manufacture a belt main body made of the polyamideimide resin or the polyimide resin. Next, in a state in which the belt main body is inserted into a cylindrical pipe and is wound around the cylindrical pipe or in a state in which the belt main body is once removed from a molding pipe and is placed on different two-axis roll, a pair of blades set to a predetermined width is inserted and one turn of the belt is made, whereby the belt main body having any desired width can be manufactured.

<Guide Member>

In the embodiment, preferably the image formation apparatus belt has the belt main body provided with a guide member.

When the belt main body is placed on roll and a move force attempting to move in the roll axial direction occurs, a reaction force (stress) of the same strength as the move force occurring against the move force is imposed directly on the guide member. From the viewpoint for the guide member to be able to disperse and absorb the stress to some extent, preferably the guide member is an elastic member having durometer hardness ranging from A60 to A90; particularly preferably the guide member is an elastic member having durometer hardness ranging from A70 to A90. If the durometer hardness is in the range mentioned above, the guide member does not run on the support roll or the belt main body always follows the belt support roll. The durometer hardness is measured using a type A durometer in conformity with JIS K 6253 (1997).

As a material of an elastic member having the durometer hardness as mentioned, an elastic body, etc., having adequate hardness such as a polyurethane resin, neoprene rubber, polyurethane rubber, silicone rubber, a polyester elastomer, chloroprene rubber, or nitrile rubber can be used. Among them, particularly, polyurethane rubber or silicone rubber can be used preferably considering electric insulating property, moisture resistance, solvent resistance, ozone resistance, heat resistance, and abrasion resistance.

The cross-sectional shape of the guide member can be determined as required according to the use condition of the belt, etc. To provide a sufficient meandering prevention effect, preferably the cross-sectional shape is made roughly rectangular. From the viewpoint of the meandering prevention effect, durability, etc., preferably the width of the guide member usually is 1 to 10 mm; particularly preferably, 4 to 7 mm. The thickness of the guide member is not limited. From the viewpoint of the meandering prevention effect, durability, etc., preferably the thickness of the guide member usually is 0.5 to 5 mm; particularly preferably, 1 to 2 mm.

<Reinforcing Member>

In the embodiment, the belt main body can also be provided with a reinforcing member. The reinforcing member can be provided in an end part in the width direction of either or both of the outer and inner peripheral surfaces of the belt main body for suppressing a belt crack caused by distortion of the belt main body, etc., (see FIG. 2D). To provide the reinforcing member on the inner peripheral surface of the belt, a mode in which the reinforcing member is placed on the belt main body and the guide member is adhered to and/or placed on the reinforcing member can be exemplified. As the reinforcing member is provided, if the belt runs on a collar provided for the stretch roll, etc., a bend portion is suppressed and stress concentration is eased.

As the reinforcing member, for example, polyimide tape, a hard rubber member, etc., can be used, but the material is not limited; preferably it is selected in response to the thickness limitation, the required strength, elasticity, etc. Information on the reinforcing member is provided in Japanese Patent Laid-Open No. 2000-337464, 2004-252487, 2004-46199, 2006-227412, etc.

[Manufacturing of Image Formation Apparatus Belt]

A manufacturing method of the belt of the embodiment will be discussed.

The belt main body can be manufactured by the known method of applying a solution provided by mixing a solvent and a solvent soluble resin, and a conductant agent, etc., as required to the outer face of a cylindrical body, drying, heating, and calcinating it, and then peeling off the resin coat from the cylindrical body, etc., for example, as described above.

A forming method of the recess is not limited; the recess may be formed by pressing a member matched with any desired recess size while the belt is being manufactured or may be formed by mechanically or chemically providing a notch after the belt is manufactured.

Figure 4A:
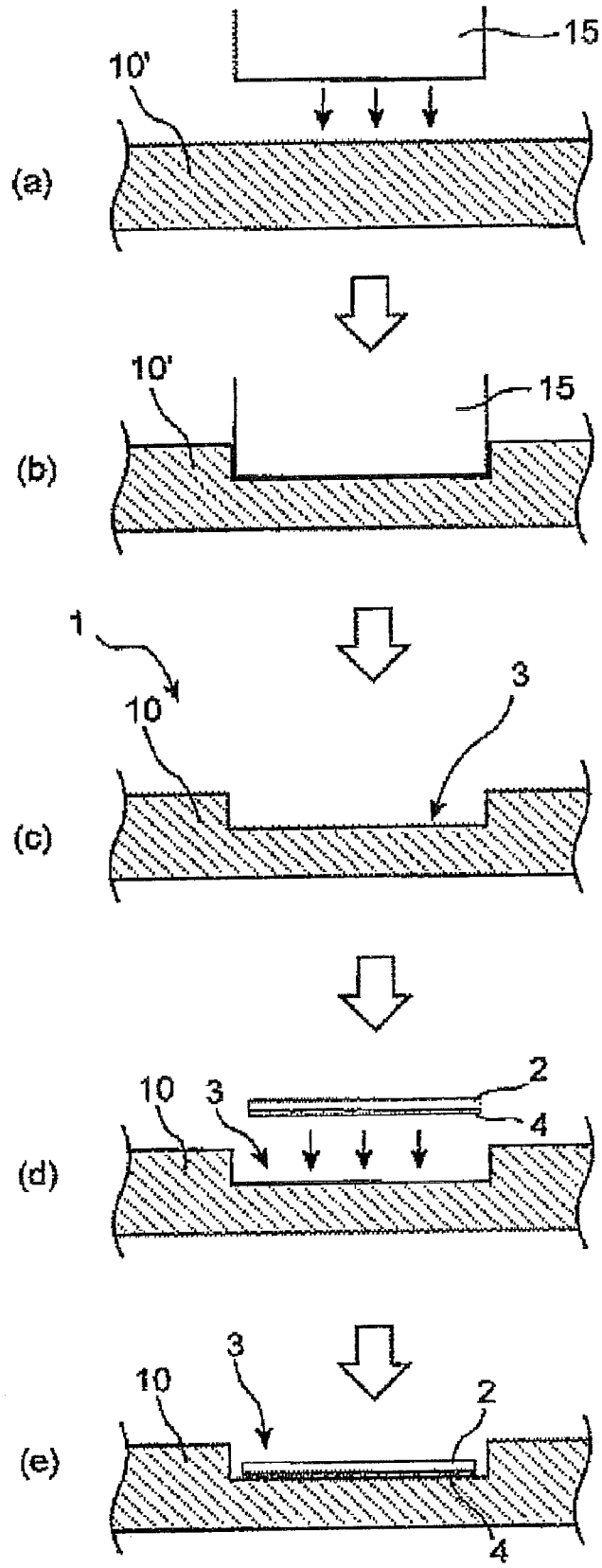
FIGS. 4A to 4D are sectional conceptual drawings to show exemplary embodiments of a manufacturing method of the belt.

Referring to FIGS. 4A to 4D, the manufacturing method will be discussed specifically. FIG. 4A is a sectional conceptual drawing to show one exemplary embodiment of the belt manufacturing method. In FIG. 4A, (a) shows a coating film 10' applied and dried (before heated and calcined). Since the coating film 10' is before it is heated and calcined, a proper resin member 15 is pressed against the coating film from above (FIG. 4A, (b)), whereby a recess 3 can be formed (FIG. 4A, (c)). After the coating film 10' is calcined, a detected part 2 is fixedly secured to the formed recess 3 through an adhesive 4 (FIG. 4A, (d)), whereby a belt 1 with the detected part 2 placed in the recess 3 formed in the belt can be manufactured (FIG. 4A, (e)).

Figure 4B:
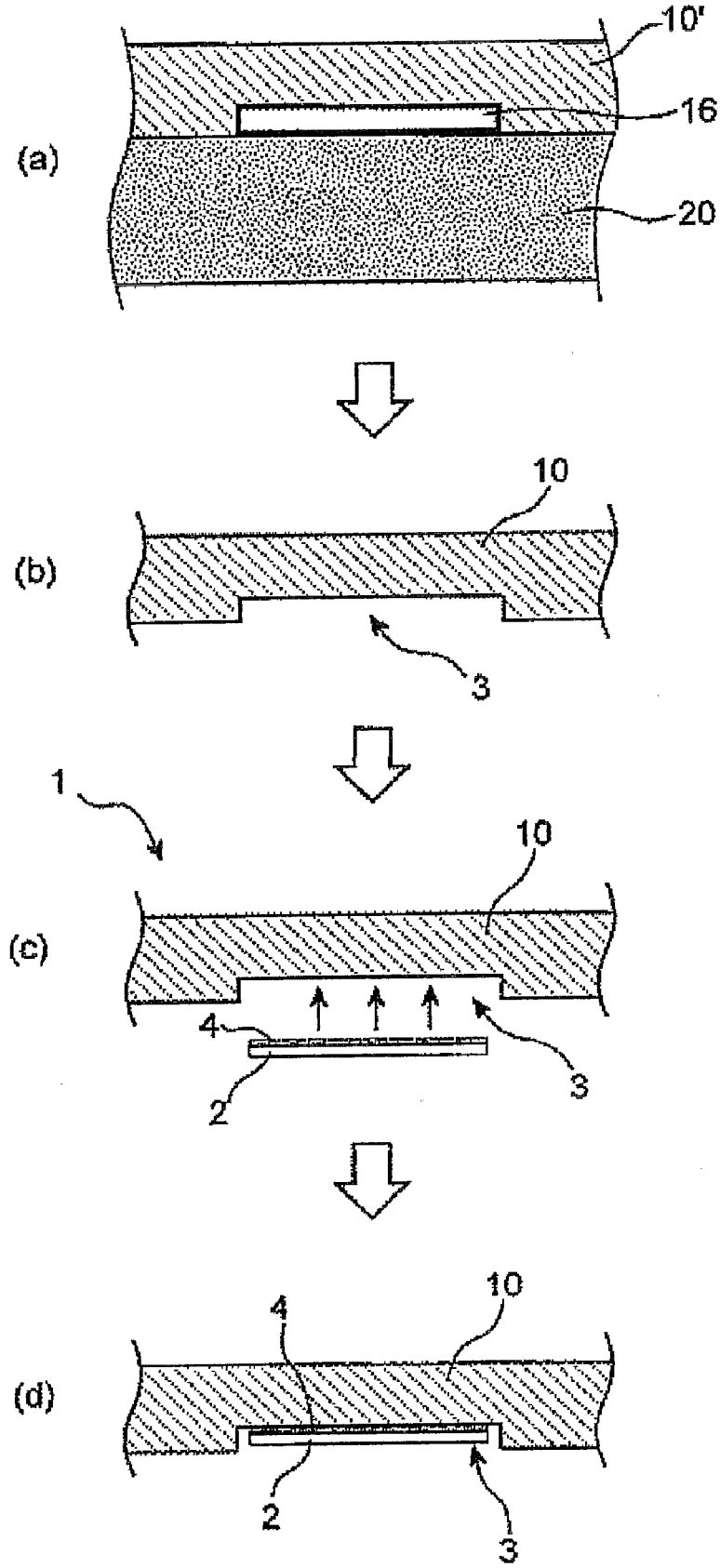

FIG. 4B is a sectional conceptual drawing to show another exemplary embodiment of the belt manufacturing method. In (a) of FIG. 4B, a resin film (for example, a polyimide film) 16 is wound around a cylindrical body (core body) 20 and an applying liquid is applied in the range containing the resin film 16 and is dried, heated, and calcined. The provided resin coat is peeled off from the cylindrical body and the resin film 16 is stripped off, whereby a belt main body 10 having a recess 3 on the back (inner peripheral surface) can be manufactured (FIG. 4B, (b)).

Figure 4C:
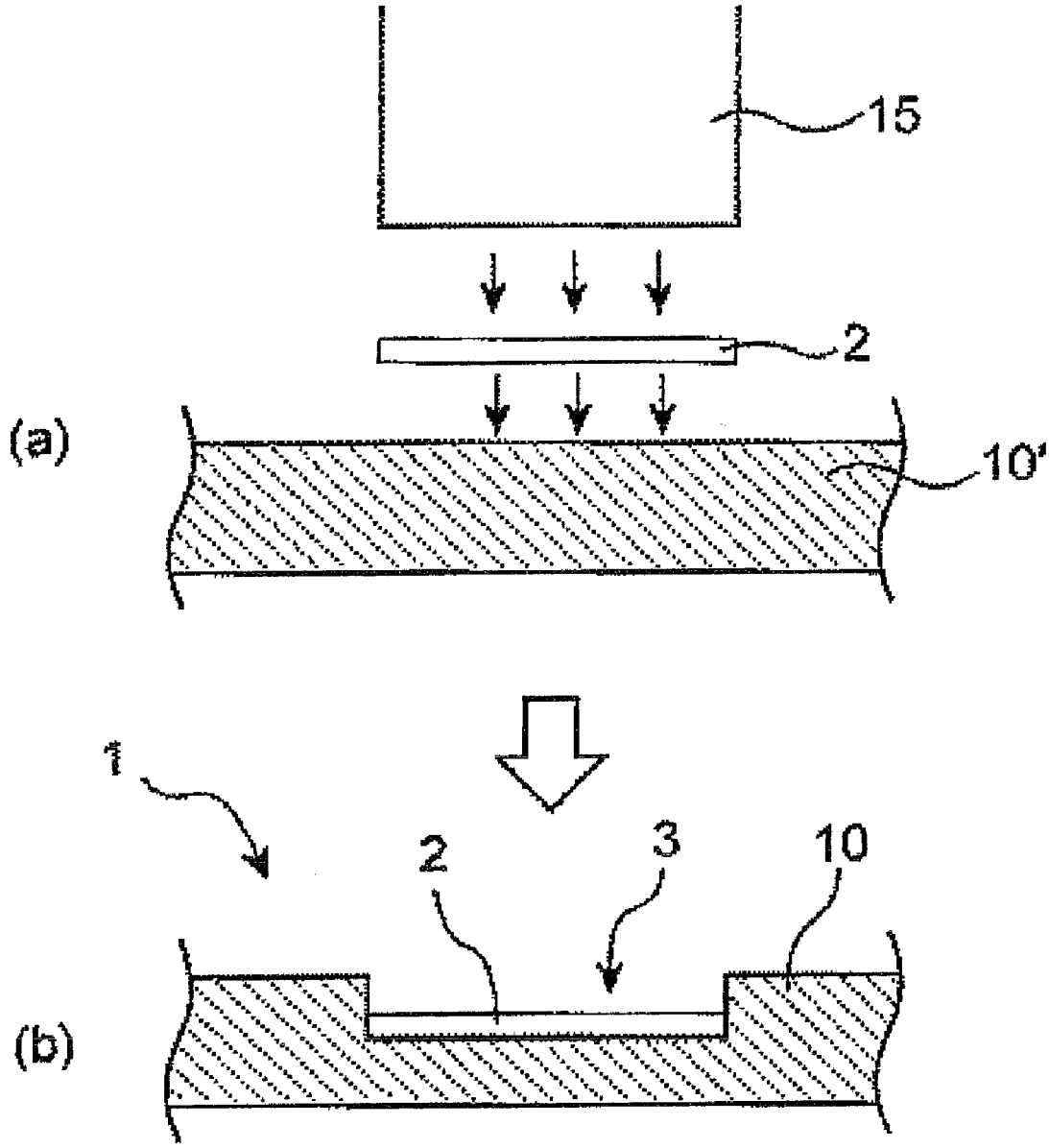
Figure 4D:
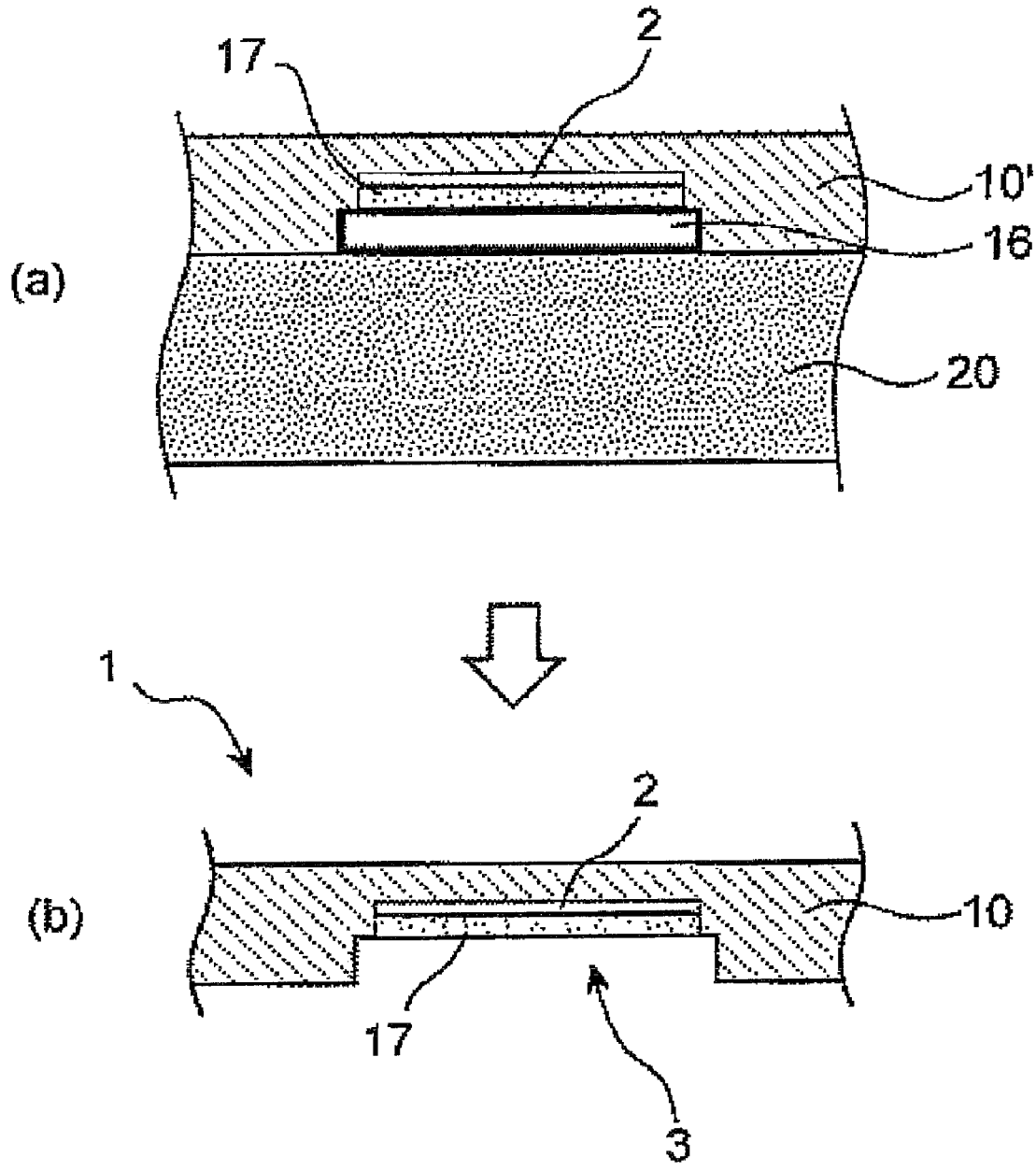

A detected part 2 is adhered to the thus formed recess 3 through an adhesive 4 (FIG. 4B, (c)), whereby a belt 1 with the detected part 2 placed in the recess 3 formed in the belt can be manufactured (FIG. 4D, (d)).

FIG. 4C is a sectional conceptual drawing to show another exemplary embodiment of the belt manufacturing method.

In (a) of FIG. 4C, a detected part 2 is pressed against an applied and dried coating film 10' from above with a proper resin member 15 and a recess 3 is provided in the dried film and the detected part 2 is placed on the inner bottom of the recess. Then, heating and calcination are performed, whereby a belt 1 with the detected part 2 placed in the recess 3 formed in the belt can be manufactured (FIG. 4C, (b)).

FIG. 4D is a sectional conceptual drawing to show another exemplary embodiment of the belt manufacturing method.

In (a) of FIG. 4D, a resin film (for example, a polyimide film) 16, a detected part 2, and an optically transparent resin film 17 are placed on a cylindrical body (core body) 20 in this order and an applying liquid is applied to the area containing the resin film (polyimide film) 16 and the detected part 2 and is dried, heated, and calcined. The provided resin coat is peeled off from the cylindrical body 20 and the resin film 16 is stripped off, whereby a belt 1 having a recess 3 on the back (inner peripheral surface) with the detected part 2 having a surface protected by the optically transparent resin film 17, placed on the inner bottom of the recess can be manufactured (FIG. 4D, (b)).

To place the recess part and the detected part in the guide member, a similar method to that described above can also be applied.

The belt manufacturing method is not limited to those described above and methods known by those skilled in the art can be used in proper combination as required, needless to say.

To manufacture a belt, a sheet-like belt main body and a guide member may be adhered and then the ends of the belt main body may be adhered to manufacture an annular belt or after a belt main body is formed like a ring, a guide member may be adhered to manufacture a belt. The guide member may be provided only along one side margin of the belt main body; from the viewpoint of furthermore providing the meandering prevention effect, durability, the reinforcing effect, and the like, particularly when the belt main body is wide, more preferably the guide member is provided along both side margins of the belt main body. The adhesion position of the guide member to the belt main body (the distance from the side margin) is set as required in response to the application and the function of the belt, the apparatus using the belt, etc. The guide member may be adhered along the end of the belt main body or may be fixed to an appropriate position to the center side of the belt main body from the end.

In FIG. 1, the belt has the guide member 12 adhered to the inner face of the belt main body 10; the guide member 12 may be adhered to the outer face of the belt main body 10 in response to the application of the belt 1. Preferably, the guide member 12 is provided on the entire peripheral surface from the viewpoint of the reinforcing effect of the belt 1; a gap of about 1 to 10 mm may exist in the joint of the guide member.

Preferably, the belt main body and the guide member are fixed in the circumferential direction to the belt main body along at least one side margin of the belt main body. To fix, preferably the belt main body and the guide member are fixed with an adhesion part.

<Belt Stretching Unit, Guide Member Guide Method>

Another aspect of the embodiment of the invention relates to a belt stretching unit and the above-described belt and a plurality of rolls for stretching and supporting the belt from the inside are included.

That is, the belt of the embodiment can be used in a belt stretching unit including a plurality of rolls for stretching and supporting the belt from the inside. The number of the rolls is two or more; preferably two to four.

<Image Formation Apparatus>

The image formation apparatus of the embodiment is not limited if it is an image formation apparatus using the belt of the embodiment. The belt is used as a sheet conveying belt or an intermediate transfer belt, for example. As the type of image formation apparatus, an ordinary single-color image formation apparatus with only single-color toner stored in a developing unit, a color image formation apparatus for repeating primary transfer of a tone image supported on an image supporter such as a photoconductive drum to an intermediate transfer body in sequence, a tandem color image formation apparatus wherein a plurality of image supporters each including a developing unit for each color are placed on an intermediate transfer body in series, etc., can be named.

Figure 5:
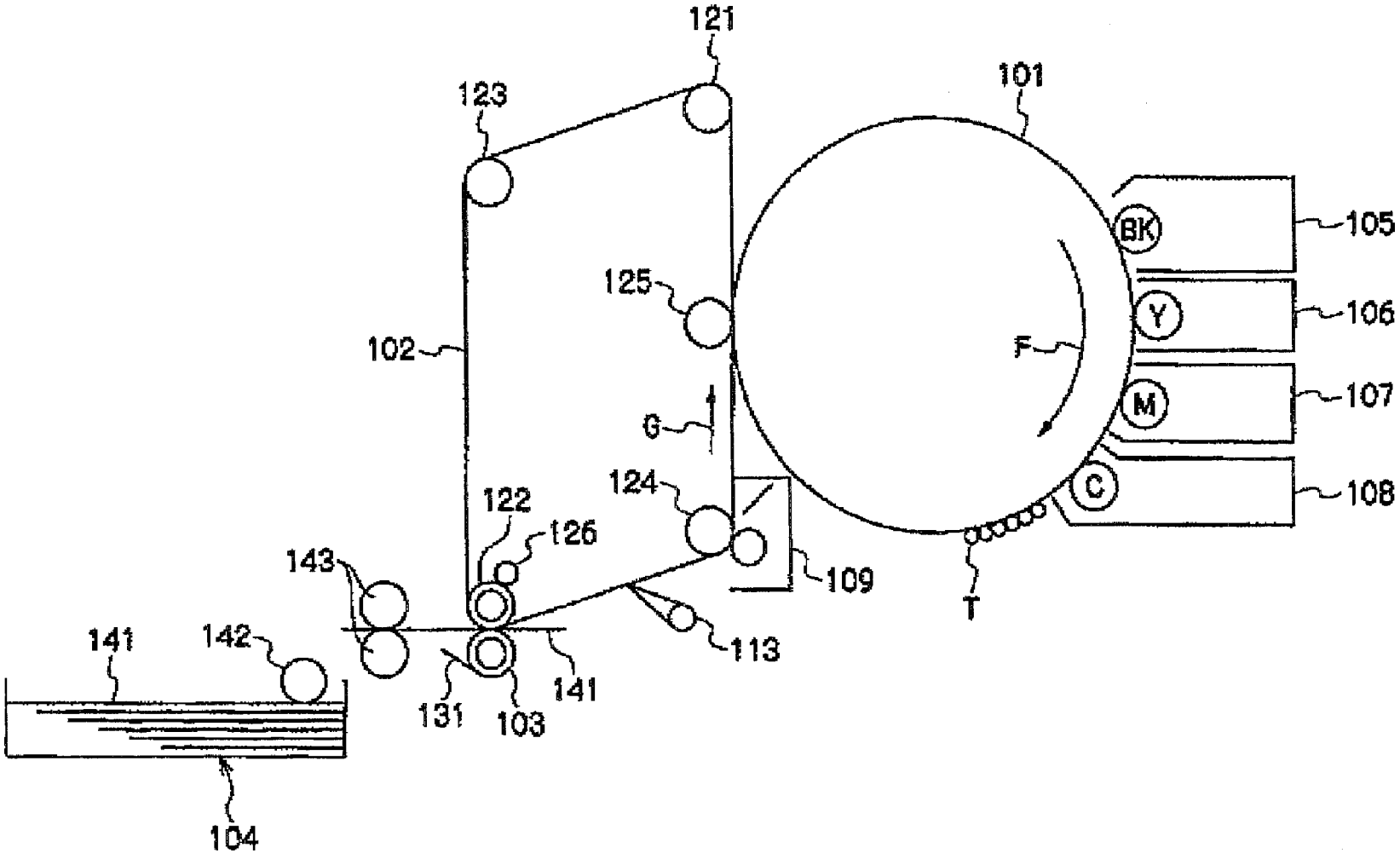
FIG. 5 is a schematic configuration drawing of an example of an image formation apparatus including the belt of the exemplary embodiment of the invention as an intermediate transfer belt.

A color image formation apparatus for repeating primary transfer is shown below as an example of the image formation apparatus of the embodiment: FIG. 5 is a schematic drawing to show an image formation apparatus including the belt of the embodiment of the invention as an intermediate transfer belt.

The image formation apparatus shown in FIG. 5 includes a photoconductive drum 101 as an image supporter, an intermediate transfer belt 102 as an intermediate transfer body, a bias roll 103 of a transfer electrode, a sheet tray 104 for supplying a sheet of paper of a transfer medium, a developing unit 105 using BK (black) toner, a developing unit 106 using Y (yellow) toner, a developing unit 107 using M (magenta) toner, and a developing unit 108 using C (cyan) toner, a belt cleaner 109, a peeling claw 113, belt support rolls 121, 123, and 124, a backup roll 122, a conductive roll 125, an electrode roll 126, a cleaning blade 131, a sheet of paper 141, a pickup roll 142, and feed rolls 143. The belt of the embodiment is used as the intermediate transfer belt 102.

A guide member included on the inner face of the intermediate transfer belt 102 is positioned so as to abut the side margins of the belt support rolls 121, 123, and 124 and thus the intermediate transfer belt 102 is guided by the guide member at the belt running time and does not meander at the belt running time.

In the image formation apparatus shown in FIG. 5, the photoconductive drum 101 rotates in the arrow F direction and has a surface uniformly charged by a charging unit not shown. Image write means such as a laser writer forms an electrostatic latent image of a first color (for example, black (BK)) on the charged photoconductive drum 101. This electrostatic latent image is developed in toner by the developing unit 105 to form a visualized toner image T. As the photoconductive drum 101 rotates, the toner image T arrives at a primary transfer section where the conductive roll 125 is placed, and an electric field of an opposite polarity is caused to act on the toner image T from the conductive roll 125, whereby while the toner image T is electrostatically attracted onto the intermediate transfer belt 102, it is primarily transferred as the intermediate transfer belt 102 rotates in the arrow G direction. The conductive roll 125 may be placed just below the photoconductive drum 101 as shown in FIG. 5 or may be placed at a position deviating from the position just below the photoconductive drum 101.

Likewise, a toner image of a second color (for example, yellow (Y)), a toner image of a third color (for example, magenta (M)), and a toner image of a fourth color (for example, cyan (C)) are formed in order by the developing units 106, 107, and 108 and are superposed on each other on the intermediate transfer belt 102 to form a multi-toner image. The toner at this time may be mono component toner or may be dual-component toner.

To superpose multiple toners on the intermediate transfer belt 102, a detected part made of aluminum placed on the inner bottom face of a recess provided in the intermediate transfer belt can be optically detected as a reference mark. For the optical position detection, a detection unit (not shown) using a light emission element of light emission means and a light reception element of light reception means for outputting a voltage in response to the reflection amount of light emitted from the light emission element in combination is provided in the circumferential direction of the belt.

To combine a light reception member with the belt main body or the guide member containing carbon black, the light reflection amount grows rapidly on the surface of the detected part, causing the detection voltage of the light reception element to increase stepwise; upon return to the belt main body or the guide member, the light reflection amount lowers stepwise.

The voltage change responsive to the light reflection amount is output to a control section (not shown) and the position of the intermediate transfer belt is detected in synchronization with the detection timing of the detected part and registration of the multi-toner image can be conducted.

The multi-toner image transferred to the intermediate transfer belt 102 arrives at a secondary transfer section where the bias roll 103 is installed as the intermediate transfer belt 102 rotates. The secondary transfer section is made up of the bias roll 103 installed on the surface of the intermediate transfer belt 102 where the toner image is supported, the backup roll 122 placed so as to face the bias roll 103 from the back of the intermediate transfer belt 102, and the electrode roll 126 for coming in press contact with the backup roll 122 for rotation.

As the sheet of paper 141, one at a time is taken out using the pickup roll 142 from a sheet bundle stored in the sheet tray 104 and is fed into the nip between the intermediate transfer belt 102 and the bias roll 103 in the secondary transfer section at a predetermined timing using the feed rolls 143. The toner image supported on the intermediate transfer belt 102 is transferred to the fed sheet 141 by press contact conveyance of the bias roll 103 and the backup roll 122 and rotation of the intermediate transfer belt 102.

The sheet to which the toner image has been transferred is stripped off from the intermediate transfer belt 102 by operating the peeling claw 113 placed at a retraction position until primary transfer completion of the final toner image, and is conveyed to a fixing unit not shown and the toner image is fixed by pressurization/heating treatment to form a permanent image. The intermediate transfer belt 102 upon completion of transferring the multi-toner image to the sheet has the remaining toner removed by the belt cleaner 109 provided downstream from the secondary transfer section for the next transfer. The cleaning blade 131 made of polyurethane, etc., is attached to the bias roll 103 so as to abut the bias roll 103 at all times for removing foreign substances of toner particles, paper dust, etc., deposited in the transfer.

To transfer a single-color image, the primarily transferred toner image T is immediately secondarily transferred and the sheet 141 is conveyed to the fixing unit; to transfer a multi-color image with multiple colors superposed on each other, rotation of the intermediate transfer belt 102 and rotation of the photoconductive drum 101 are synchronized with each other so that the color toner images match precisely in the primary transfer section, thereby preventing the color toner images from shifting. In the secondary transfer section, output voltage (transfer voltage) of the same polarity as the polarity of the toner image is applied to the electrode roll 126 in press contact with the backup roll 122 placed facing the bias roll 103 with the intermediate transfer belt 102 between, thereby transferring the toner image to the sheet by electrostatic repulsion.

The image can be thus formed.

Figure 6:
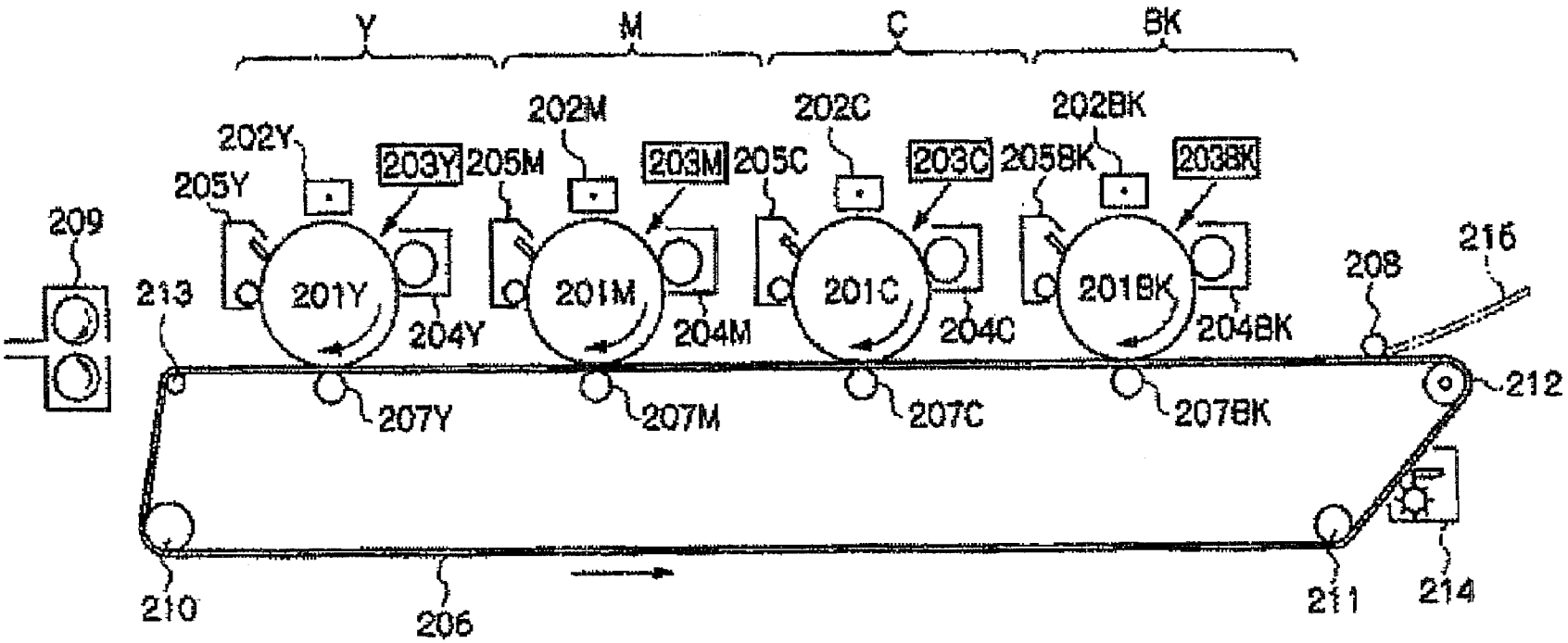
FIG. 6 is a schematic configuration drawing of an example of an image formation apparatus including the belt of the exemplary embodiment of the invention as a sheet conveying belt.

Next, another example of the image formation apparatus of the embodiment is shown. FIG. 6 is a schematic drawing to show an image formation apparatus including the belt of the embodiment of the invention as a sheet conveying belt.

The image formation apparatus shown in FIG. 6 includes units Y, M, C, and BK, a sheet conveying belt 206, transfer rolls 207Y, 207M, 207C, and 207BK, a sheet conveying roll 208, and a fixer 209. The belt of the embodiment is used as the sheet conveying belt 206.

A guide member (not shown) included on the inner face of the sheet conveying belt 206 is positioned so as to abut the side margins of belt support rolls 210, 211, 212, and 213 and thus the sheet conveying belt 206 is guided by the belt member at the belt running time. The guide member is fitted into a guide groove formed in the belt support roll 210, etc., and the sheet conveying belt 206 runs, so that the sheet conveying belt 206 does not meander at the belt running time.

The units Y, M, C, and BK include photoconductive drums 201Y, 201M, 201C, and 201BK that can rotate at predetermined circumferential speed (process speed) clockwise in the arrow direction. The photoconductive drums 201Y, 201M, 201C, and 201BK are surrounded by charging rolls 202Y, 202M, 202C, and 202BK, exposure devices 203Y, 203M, 203C, and 203BK, color developing units (a yellow developing unit 204Y, a magenta developing unit 204M, a cyan developing unit 204Y, and a black developing unit 204BK), and photoconductive drum cleaners 205Y, 205M, 205C, and 205BK.

The units Y, M, C, and BK are placed in the order of the units BK, C, M, and Y in parallel with the sheet conveying belt 206, but can be placed in any proper order conforming to the image formation method, such as the order of the units BK, Y, C, and M.

The sheet conveying belt 206 can rotate at the same circumferential speed as the photoconductive drums 201Y, 201M, 201C, and 201BK counterclockwise in the arrow direction by the belt support rolls 210, 211, 212, and 213. It is placed so that a part of the sheet conveying belt 206 positioned between the belt support rolls 212 and 213 comes in contact with the photoconductive drums 201Y, 201M, 201C, and 201BK. The sheet conveying belt 206 is provided with a belt cleaning unit 214.

The transfer rolls 207Y, 207M, 207C, and 207BK are placed on the inner side of the sheet conveying belt 206 and at the positions opposed to the portions where the sheet conveying belt 206 and the photoconductive drums 201Y, 201M, 201C, and 201BK are in contact with each other, and the transfer rolls 207Y, 207M, 207C, and 207BK and the photoconductive drums 201Y, 201M, 201C, and 201BK form transfer areas (nip parts) for transferring each toner image to a sheet (transfer medium) 216 with the sheet conveying belt 206 between. The transfer rolls 207Y, 207M, 207C, and 207BK may be placed just below the photoconductive drums 201Y, 201M, 201C, and 201BK as shown in FIG. 6 or may be placed at positions deviating from the positions just below the photoconductive drums 201Y, 201M, 201C, and 201BK.

The fixer 209 is placed so that the sheet of paper can be conveyed after passing through the transfer areas (nip parts) between the sheet conveying belt 206 and the photoconductive drums 201Y, 201M, 201C, and 201BK.

The sheet 216 is conveyed on the sheet conveying belt 206 by the sheet conveying roll 208.

In the image formation apparatus shown in FIG. 6, the photoconductive drum 201BK is rotated in the unit BK. The charging roll 202BK is driven in operative association with rotation of the photoconductive drum 201BK and uniformly charges the surface of the photoconductive drum 201BK at a predetermined polarity and potential. The photoconductive drum 201BK having the surface uniformly charged is then exposed like an image by the exposure device 203BK, and an electrostatic latent image is formed on the surface.

Subsequently, the electrostatic latent image is developed by the black developing unit 204BK. Then, a toner image is formed on the surface of the photoconductive drum 201BK. The toner at this time may be mono component toner or may be dual-component toner. The toner at this time may be mono component toner or may be dual-component toner.

The toner image passes through the transfer area (nip part) between the photoconductive drum 201BK and the sheet conveying belt 206 and at the same time, the sheet 216 is electrostatically attracted onto the sheet conveying belt 206 and is conveyed to the transfer area (nip part) and the toner image is transferred to the surface of the sheet 216 according to an electric field formed by a transfer bias applied from the transfer roll 207BK.

Then, the toner remaining on the photoconductive drum 201BK is cleaned and removed by the photoconductive drum cleaner 205BK. The photoconductive drum 201BK is provided for the next transfer cycle.

The transfer cycle described above is also executed in a similar manner in the units C, M, and Y.

The sheet 216 to which the toner images are transferred by the transfer rolls 207BK, 207C, 207M, and 207Y is further conveyed to the fixer 209 and is fixed.

Any desired image is thus formed on the sheet of paper.

Figure 7:
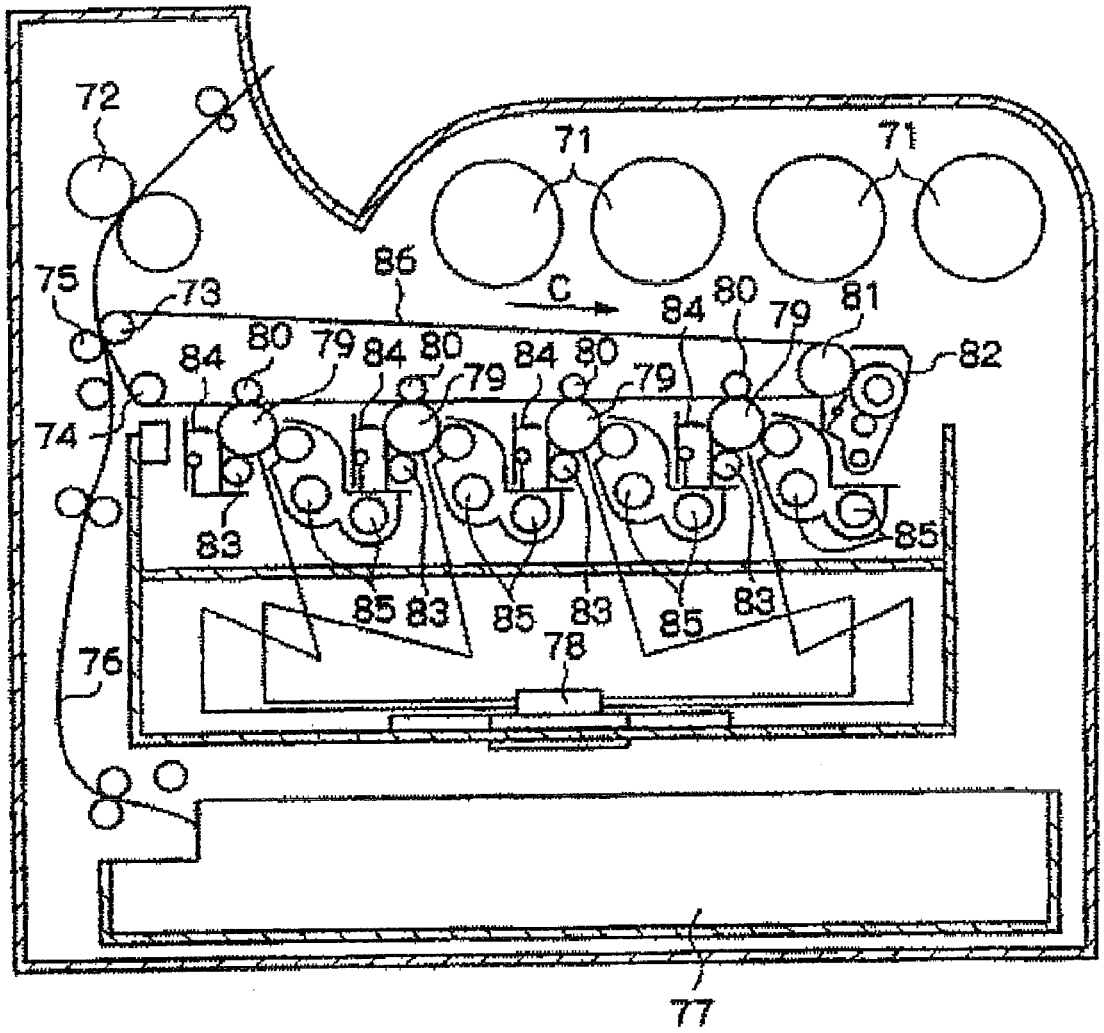
FIG. 7 is a schematic configuration drawing of an example of a tandem image formation apparatus including the belt of the exemplary embodiment of the invention as an intermediate transfer belt.

Further, another example of the image formation apparatus of the embodiment is shown. FIG. 7 is a schematic drawing to describe the main part of a tandem image formation apparatus including the belt of the embodiment of the invention as an intermediate transfer belt.

Specifically, the tandem image formation apparatus can include charging rolls 83 (charging units) for charging the surfaces of photoconductive bodies 79, a laser generation unit 78 (exposure unit) for exposing the surfaces of the photoconductive bodies 79 and forming electrostatic latent images, developing devices 85 (developing units) for developing the latent images formed on the surfaces of the photoconductive bodies 79 using developers to form toner images, primary transfer rolls 80 for transferring the developed toner images to an intermediate transfer belt 86, photoconductive body cleaners 84 (cleaning units) for removing toner, dust, etc., deposited on the photoconductive bodies 79, a fixing roll 72 for fixing the toner image on the transfer medium, and the like as desired according to a known method as required. Each primary transfer roll 80 may be placed just above the photoconductive body 79 as shown in FIG. 7 or may be placed at a position deviating from the position just above the photoconductive body 79. The belt of the embodiment is included as the intermediate transfer belt 86, so that high transfer image quality can also be provided stably in the tandem image formation apparatus as described above.

Further, the configuration of the image formation apparatus shown in FIG. 7 will be discussed in detail. The image formation apparatus shown in FIG. 7 includes four toner cartridges 71, a pair of fixing rolls 72, a backup roll 73, a tension roll 74, a secondary transfer roll 75, a sheet passage 76, a sheet tray 77, the laser generation unit 78, the four photoconductive bodies 79, the four primary transfer rolls 80, a drive roll 81, a transfer cleaner 82, the four charging rolls 83, the photoconductive body cleaners 84, the developing devices 85, the intermediate transfer belt 86, and the like as the main components.

To begin with, each photoconductive body 79 is surrounded counterclockwise by the charging roll 83, the developing device 85, the primary transfer roll 80 with the intermediate transfer belt 86 between, and the photoconductive body cleaner 84. One set of the members form the developing unit corresponding to one color. The toner cartridges 71 for replenishing the developing devices 85 with developers are provided in a one-to-one correspondence with the developing units. For the photoconductive body 79 of each developing unit, the laser generation unit 78 that can irradiate the surface of the photoconductive body 79 between the charging roll 83 and the developing device 85 with laser light responsive to image information is provided.

The four developing units corresponding to four colors (for example, cyan, magenta, yellow, and black) are placed in series almost in a horizontal direction in the image formation apparatus, and the intermediate transfer belt 86 is provided so as to pass through the nip part between the photoconductive body 79 and the primary transfer roll 80 of each of the four developing units. The intermediate transfer belt 86 is stretched on the backup roll 73, the tension roll 74, and the drive roll 81 provided in order counterclockwise on the inner peripheral surface of the intermediate transfer belt. The four primary transfer rolls 80 are positioned between the backup roll 73 and the tension roll 74. The transfer cleaner 82 for cleaning the outer peripheral surface of the intermediate transfer belt 86 is provided so as to come in press contact with the drive roll 81 on the opposite side to the drive roll 81 with the intermediate transfer belt 86 between.

The secondary transfer roll 75 for transferring the toner image formed on the outer peripheral surface of the intermediate transfer belt 86 to the surface of a record sheet of paper conveyed via the sheet passage 76 from the sheet tray 77 is provided so as to come in press contact with the backup roll 73 on the opposite side to the backup roll 73 with the intermediate transfer belt 86 between.

The sheet tray 77 for storing record sheets of paper is provided on the bottom of the image formation apparatus, and a sheet of paper can be supplied so as to pass through the press contact part between the backup roll 73 and the secondary transfer roll 75 making up a secondary transfer section via the sheet passage 76 from the sheet tray 77. The record sheet passing through the press contact part can be conveyed by conveying means (not shown) so as to further pass through the press contact part between the paired fixing rolls 72, and finally can be discharged to the outside of the image formation apparatus.

Next, an image formation method using the image formation apparatus in FIG. 7 will be discussed. A toner image is formed for each developing unit. After the surface of the photoconductive body 79 rotating counterclockwise is uniformly charged by the charging roll 83, a latent image is formed on the charged surface of the photoconductive body 79 by the laser generation unit 78 (exposure unit). Next, the latent image is developed in a developer supplied from the developing device 85 to form a toner image, and the toner image conveyed to the press contact part between the primary transfer roll 80 and the photoconductive body 79 is transferred to the outer peripheral surface of the intermediate transfer belt 86 rotating in the arrow C direction. Upon completion of transferring the toner image, the toner, dust, etc., deposited on the surface of the photoconductive body 79 is cleaned by the photoconductive body cleaner 84 for the next toner image formation.

The toner image developed for each color developing unit is conveyed to the secondary transfer section in a state in which the toner images are superposed on each other in order on the outer peripheral surface of the intermediate transfer belt 86 so as to correspond to image information. The secondary transfer roll 75 causes the toner image to be transferred to the surface of the record sheet conveyed via the sheet passage 76 from the sheet tray 77. The record sheet to which the toner image is transferred further passes through the press contact part between the paired fixing rolls 72 making up a fixing section. At this time, the record sheet is pressurized and heated, whereby it is fixed. After an image is formed on the surface of the record sheet, the record sheet is discharged to the outside of the image formation apparatus.

EXAMPLES

The embodiment will be discussed below further specifically according to examples. It is to be understood that the embodiment is not limited to the examples.

(Manufacturing of Belt Main Body)

<Applying Liquid: Polyimide Precursor Solution>

23 parts by weight of dried oxidized carbon black (SPEDIAL BLACK4 manufactured by Degussa) were added relative to 100 parts by weight of polyimide-based resin solid content of N-methyl-2pyrolidone (NMP) solution of polyamic acid made up of 3,3',4,4'-biphenyl tetracarboxylic dianhydride (BPDA) and p-phenylene diamine oxydianiline (ODAPDA) (U varnish RS manufactured by Ube Kousan (Kabu)). The material was allowed to pass through five times a passage where it is divided into two pieces with the minimum area 1.4 $mm^2$ at pressure 200 MPa and then collided and again divided into two pieces using a collision type dispenser to mix and provide a carbon black dispersed polyamic acid solution with viscosity 150 poises.

<Belt Manufacturing—1>

Using a cylindrical base material made of aluminum having an outer diameter of 190 mm, a length of 600 mm, and a thickness of 5 mm on which a releasing agent was previously baked as a molding core body, while the core body was rotated at 100 rpm, the polyimide precursor solution was applied to the outer peripheral surface of the core body with an applying length of 350 mm and a thickness of 0.5 mm while a dispenser and a scraper were moved at speed 150 min/min. Then, while the core body was rotated at 5 rpm, it was heated and dried at 120° C. for 30 minutes and was cooled to room temperature and then was heated and calcined for two hours to 300° C., whereby solvent removal and imide conversion were performed. Last, the core body was cooled to room temperature and then a polyimide seamless pipe substance was separated from the core body and was cut to a width of 340 mm. Accordingly, a seamless belt having an outer diameter of 190 mm, a thickness of 80 μm, and a width of 340 mm was provided.

Next, using a polyurethane member having a width of 5 mm, a thickness of 1 mm, a length of 590 mm, and hardness 70° (manufactured by Tigers Polymer; TR100-70) as a rib guide, a silicone-based adhesive (Super X, manufactured by Cemedine Co. Ltd.) was applied to one face of the rib guide and the rib guide was put along the inner peripheral surface on both outsides in the width direction of the seamless belt to provide the seamless belt with the rib guide.

(Manufacturing of Light Reflecting Member)

<Light Reflecting Member A>

Al was evaporated on the surface of a PET film and a silicone-based adhesive was applied to an opposite end of the PET film to produce a sheet measuring 10 mm square 5 μm in total thickness, and this sheet was adopted as light reflecting member A.

<Light Reflecting Member B>

An Al sheet measuring 10 mm square and 5 μm in thickness was adopted as light reflecting member B.

<Light Reflecting Member C>

Precursor Tyranno polymer of ceramic film (Ube Kousan, VN-100) was applied to an Al sheet measuring 10 mm square and 5 μm in thickness and was baked at 250° C. for one hour. The sheet was adopted as light reflecting member C coated with ceramic film. The thickness of the ceramic film after calcined was 13 μm.

(Evaluation)

For the provided seamless belt provided with each light reflecting member, using Fuji Xerox (Kabu) DocuColor a450 as an evaluating machine, sheet (light reflecting member) peeling and flaw were determined by visual observation and reflectivity was determined from the voltage of a light emission-reception sensor. The initial characteristic of the sensor was 4.5 V at the light reflecting member part; when the sensor voltage was 3.0 V or more, the reflectivity was fair and when the sensor voltage was 4.0 V or more, the reflectivity was good. Evaluation was conducted to a maximum of 500K ($500\times10^3$) cycles each corresponding to one revolution of the belt.

The placement position of the detection part and the detection target position were adjusted as required according to the position of the light reflecting member (detected part) provided on the inner or outer peripheral surface of the belt.

Example 1

Placing Light Reflecting Member on the Inner Side of Seamless Belt Surface in Thickness Direction <Belt Manufacturing>

A belt was manufactured in a similar manner to <Belt manufacturing—1> described above except that a resin member measuring 12 mm per side was pressed against a predetermined position on a dry film surface to form a recess after an application liquid was dried. Accordingly, a seamless belt containing a recess with a distance of 30 μm below the surface was provided. The light reflecting member A was put on the recess and the seamless belt provided with the light reflecting member in thickness direction 25 μm below the seamless belt surface was provided.

Figure 8A:
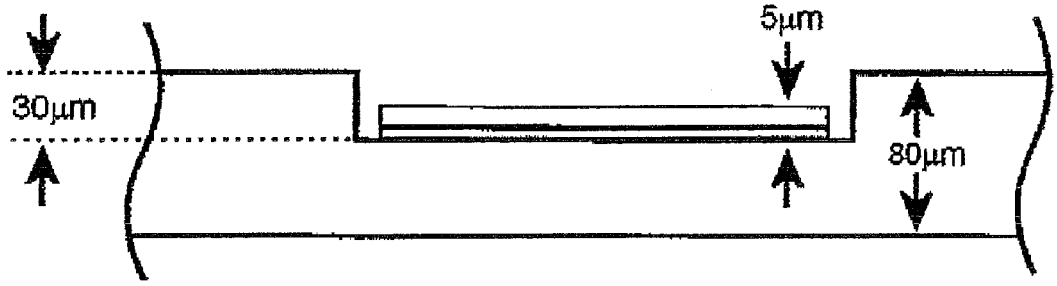
FIGS. 8A to 8D are sectional schematic drawings of image formation apparatus belts manufactured in examples.

FIG. 8A is a sectional schematic drawing of the image formation apparatus belt manufactured in Example 1. In FIG. 8A, the section taken on line X-X' in FIG. 1 is observed from the A direction. In FIG. 8A, no guide member is shown and the upper portion of the figure represents the outer peripheral surface of the belt and the lower portion represents the outer peripheral surface of the belt (the same things are applied to FIGS. 8A to 8D).

The resin member measuring 12 mm per side was pressed against the predetermined position on the dry film surface, whereby the belt is formed on the outer peripheral surface with the recess having an opening to the outside measuring 12 mm per side with the distance 30 μm below the surface. The light reflecting member A is adhered to the bottom of the recess with a silicone-based adhesive.

<Evaluation Result>

The seamless belt was evaluated up to 500K cycles. Although the light reflecting member had no flaw, slight peeling occurred in a corner of the light reflecting member, but there was no problem in running the belt and the voltage from the sensor was 4.45 V and the reflectivity was "good."

Example 2

Placing Light Reflecting Member on the Inner Side of Seamless Belt Back in Thickness Direction <Belt Manufacturing>

A belt was manufactured in a similar manner to <Belt manufacturing—1> described above except that a polyimide film having a width of 12 mm and a thickness of 30 μm to which a releasing agent was previously applied was wound around a predetermined position on a molding core body surface and an applying liquid was applied in the range containing the polyimide film. The wound polyimide film was peeled off from seamless belt, whereby a seamless belt containing a recess with a distance of 30 μm above the back and having a width of 12 mm was provided. The light reflecting member A was put on the recess and the seamless belt provided with the light reflecting member in thickness direction 25 μm above the seamless belt back was provided.

Figure 8B:
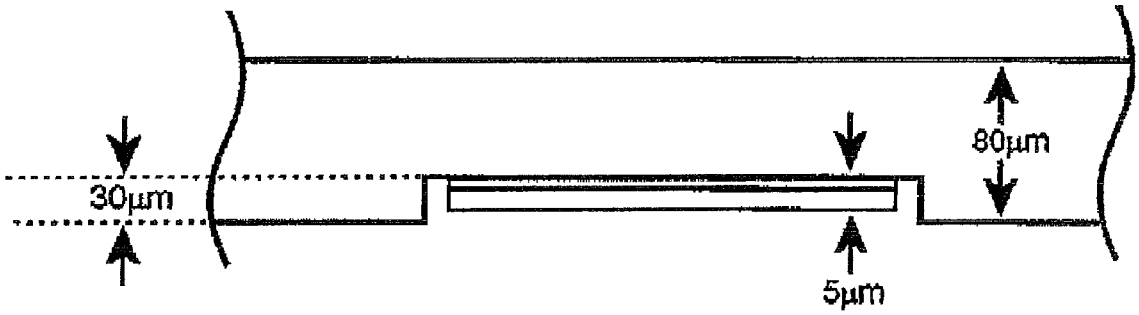

FIG. 8B is a sectional schematic drawing of the image formation apparatus belt manufactured in Example 2. In FIG. 8B, the section taken on line X-X' in FIG. 1 is observed from the A direction.

The polyimide film was wound and then the applying liquid was applied, whereby the belt is formed on the inner peripheral surface with the recess having an opening to the outside with the distance 30 μm above the back. The light reflecting member A is adhered to the bottom of the recess with a silicone-based adhesive.

<Evaluation Result>

The seamless belt was evaluated up to 500K cycles in a similar manner to that in Example 1. Although the light reflecting member had no flaw, slight peeling occurred at a corner of the light reflecting member, but there was no problem in running the belt and the voltage from the sensor was 4.45 V and the reflectivity was "good" as with Example 1.

Example 3

Placing Light Reflecting Member on the Inner Side in Thickness Direction of Surface Integral with Seamless Belt <Belt Manufacturing>

A belt was manufactured in a similar manner to <Belt manufacturing—1> described above except that the light reflecting member B was pressed against a dry film surface and was installed in the thickness direction 25 μm below the dry film surface after an application liquid was dried. Accordingly, a seamless belt integral with the light reflecting member provided in the thickness direction 25 μm below the seamless belt surface was provided. The light reflecting member was firmly adhered to the seamless belt to such an extent that it cannot be peeled off for measurement.

Figure 8C:
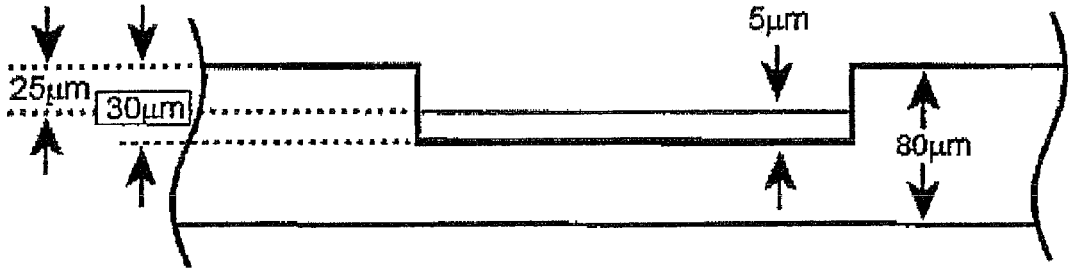

FIG. 8C is a sectional schematic drawing of the image formation apparatus belt manufactured in Example 3. In FIG. 8C, the section taken on line X-X' in FIG. 1 is observed from the A direction.

The light reflecting member B was pressed against the dried film, whereby the belt is formed on the outer peripheral surface with a recess having an opening to the outside with the distance 25 μm below the surface. The light reflecting member B having the thickness 25 μm is fixed as it is embedded in the bottom.

<Evaluation Result>

The seamless belt was evaluated in a similar manner to that in Example 1. Up to 500K cycles, the light reflecting member had neither peeling nor flaw and the voltage from the sensor was 4.49 V and the reflectivity was "good."

Example 4

Protecting Surface of Light Reflecting Member with Permeabilized Film and Placing the Light Reflecting Member on the Inner Side in Thickness Direction of Back <Belt Manufacturing>

A belt was manufactured in a similar manner to <Belt manufacturing—1> described above except that a polyimide film having a width of 12 mm and a thickness of 30 μm, a permeabilized polyimide film having a width of 12 mm and a thickness of 15 μm, and the light reflecting member B were overlapped on each other in order at a predetermined position on a molding core body surface and an applying liquid was applied in the range containing the polyimide film and the light reflecting member B. The polyimide film initially wound around the core body surface was peeled off from seamless belt, whereby a seamless belt containing the light reflecting member covered with the permeabilized polyimide film having the thickness 15 μm in thickness direction 45 μm above the seamless belt back was provided.

Figure 8D:
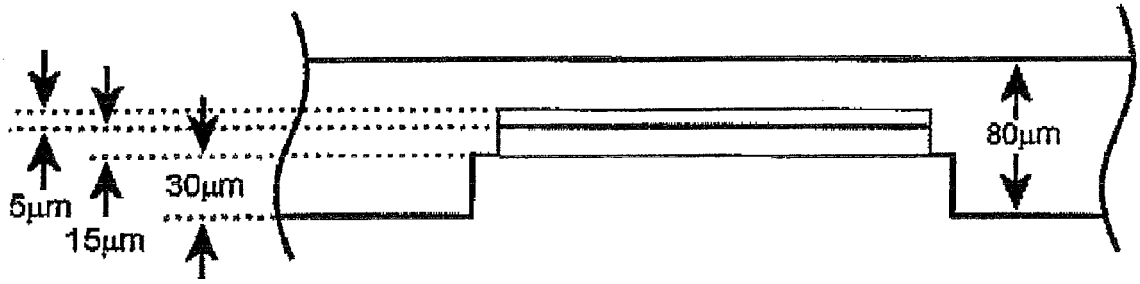

FIG. 8D is a sectional schematic drawing of the image formation apparatus belt manufactured in Example 4. In FIG. 8D, the section taken on line X-X' in FIG. 1 is observed from the A direction.

The polyimide film was wound and then the applying liquid was applied, whereby the belt is formed on the inner peripheral surface with a recess having an opening to the outside with the distance 30 μm above the back. The permeabilized polyimide film and the light reflecting member B are fixed as they are embedded in the bottom of the recess.

<Evaluation Result>

The seamless belt was evaluated in a similar manner to that in Example 1. Up to 500K cycles, the permeabilized polyimide film as well as the light reflecting member had neither peeling nor flaw. The voltage from the sensor was 3.78 V relative to the initial value 3.80 V and the reflectivity was "good."

Example 5

Placing Light Reflecting Member in Guide Member

<Belt Manufacturing>

The rib guide described above in <Belt manufacturing—1> described was formed with a recess having a width of 3.5 mm, a length of 11 mm, and a depth of 30 μm by grinding. The light reflecting member cut to 10 mm×3.2 mm is put on the recess and a silicone-based adhesive (Super X, manufactured by Cemedine Co., Ltd.) was applied to the face opposite to the recess and the rib guide was put along the inner peripheral surface on both outsides in the width direction of the seamless belt to provide the seamless belt with the rib guide.

<Evaluation Result>

The seamless belt was evaluated up to 500K cycles in a similar manner to that in Example 1. Although the light reflecting member had no flaw, slight peeling occurred at a corner of the light reflecting member, but there was no problem in running the belt and the voltage from the sensor was 4.42 V and the reflectivity was "good" as with Example 1.

Example 6

Detected Part is Covered with Ceramic Film

<Belt Manufacturing>

A belt was manufactured in a similar manner to <Belt manufacturing—1> described above except that the light reflecting member C was pressed against a dry film surface and was installed in the thickness direction 23 μm below the dry film surface after an application liquid was dried. Accordingly, a seamless belt integral with the light reflecting member C covered with a ceramic film provided in the thickness direction 23 μm below the seamless belt surface was provided. The light reflecting member was firmly adhered to the seamless belt to such an extent that it cannot be peeled off for measurement.

<Evaluation Result>

The seamless belt was evaluated in a similar manner to that in Example 1. Up to 500K cycles, the ceramic film using an organic binder as well as the light reflecting member C had neither peeling nor flaw.

The voltage from the sensor remained 4.0 V relative to the initial value 4.0 V and the reflectivity was "good."

Example 7

Placing Detected Part and Ceramic Film in Belt without Pressure Sensitive Adhesive or Adhesive <Belt Manufacturing>

A belt was manufactured in a similar manner to <Belt manufacturing—1> described above except that a resin member measuring 12 mm per side was pressed against a predetermined position on a dry film surface to form a recess with a distance of 30 μm below the surface after an application liquid was dried and except that the light reflecting member B was pressed against the recess and then ceramic film precursor Tyranno polymer (Ube Kousan, VN-100) was applied to an area measuring 12 mm square containing the light reflecting member B and was calcined at the same time as the belt. Accordingly, a seamless belt provided with the light reflecting member B in the thickness direction 25 μm below the seamless belt surface wherein the light reflecting member B covered with a ceramic film, the ceramic film, and the seamless belt are one piece was provided. The thickness of the ceramic film after calcined was 15 μm.

The light reflecting member B and the ceramic film were firmly adhered to the seamless belt to such an extent that they cannot be peeled off for measurement.

<Evaluation Result>

The seamless belt was evaluated in a similar manner to that in Example 1. Up to 500K cycles, the ceramic film using an organic binder as well as the light reflecting member B had neither peeling nor flaw.

The voltage from the sensor remained 4.0 V relative to the initial value 4.0 V and the reflectivity was "good."

Example 8

Detected Part is Ceramic Film Containing Metal Filler

<Belt Manufacturing>

A belt was manufactured in a similar manner to <Belt manufacturing—1> described above except that a resin member measuring 12 mm per side was pressed against a predetermined position on a dry film surface to form a recess with a distance of 30 μm below the surface after an application liquid was dried and except that then ceramic film precursor Tyranno polymer (Ube Kousan, VN-100) containing an Al filler was applied to the recess and was calcined at the same time as the belt. Accordingly, a seamless belt integral with the light reflecting member D of a ceramic film containing the Al filler, provided in the thickness direction 25 μm below the seamless belt surface was provided.

The Al filler is a particulate aluminum oxide having a mean particle size of 10 μm (manufactured by Sigma Aldrich Japan Kabushiki Kaisha) and two parts by weight of Al filler were added relative to 100 parts by weight of Tyranno polymer.

The light reflecting member D was firmly adhered to the seamless belt to such an extent that it cannot be peeled off for measurement.

<Evaluation Result>

The seamless belt was evaluated in a similar manner to that in Example 1. Up to 500K cycles, peeling and flaw did not occur.

The voltage from the sensor remained 3.3 V relative to the initial value 3.3 V and the reflectivity was "fair."

Comparative Example 1

<Belt Manufacturing>

The light reflecting member A was put at a predetermined position on the surface of the seamless belt provided in <Belt manufacturing—1> described above to provide a seamless belt provided with the light reflecting member on the belt surface.

<Evaluation Result>

The seamless belt was evaluated. In 200K cycles, peeling occurred in a corner and in 250K cycles, the light reflecting member completely peeled off from the belt and the function of the light reflecting member was not provided.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image formation apparatus belt, comprising:

a belt that includes a belt main body, the belt having a recess; and a detected part for position detection that is located in a side edge region of the belt, the detected part being placed in the recess provided in the belt, wherein the detected part is covered with a ceramic film.

2. The image formation apparatus belt according to claim 1, wherein the detected part is placed in the belt without a pressure sensitive adhesive or an adhesive.

3. The image formation apparatus belt according to claim 1, wherein the detected part is covered with an optically transparent resin.

4. The image formation apparatus belt according to claim 1, wherein the ceramic film is placed on the detected part without a pressure sensitive adhesive or an adhesive.

5. The image formation apparatus belt according to claim 1, wherein the ceramic film is formed by calcinating a preceramic polymer.

6. The image formation apparatus belt according to claim 1, wherein the ceramic film contains a metal filler.

7. A belt stretching unit, comprising:

an image formation apparatus belt as claimed in claim 1; and a plurality of rolls that stretch and support the image formation apparatus belt from an inside.

8. An image formation apparatus, comprising:

an image formation apparatus belt as claimed in claim 1.

* * * * *